US009551129B2

(12) United States Patent
Kami et al.

(10) Patent No.: US 9,551,129 B2
(45) Date of Patent: Jan. 24, 2017

(54) WORK MACHINE CONTROL SYSTEM, WORK MACHINE, EXCAVATOR CONTROL SYSTEM, AND WORK MACHINE CONTROL METHOD

(71) Applicant: Komatsu Ltd., Tokyo (JP)

(72) Inventors: Yoshiki Kami, Hiratsuka (JP); Masashi Ichihara, Hiratsuka (JP); Takeshi Takaura, Minou (JP)

(73) Assignee: Komatsu Ltd., Tokyo (JP)

( * ) Notice: Subject to any disclaimer, the term of this patent is extended or adjusted under 35 U.S.C. 154(b) by 198 days.

(21) Appl. No.: 14/390,590

(22) PCT Filed: May 30, 2014

(86) PCT No.: PCT/JP2014/064544

§ 371 (c)(1),
(2) Date: Oct. 3, 2014

(87) PCT Pub. No.: WO2015/181990

PCT Pub. Date: Dec. 3, 2015

(65) Prior Publication Data

US 2016/0273186 A1 Sep. 22, 2016

(51) Int. Cl.
*G06F 7/70* (2006.01)
*G06F 19/00* (2011.01)
(Continued)

(52) U.S. Cl.
CPC ..... *E02F 3/435* (2013.01); *E02F 9/265* (2013.01); *E02F 3/32* (2013.01)

(58) Field of Classification Search
CPC ..... E02F 9/265; E02F 9/2025; E02F 9/2045; A01B 79/005; A01B 69/008
(Continued)

(56) References Cited

U.S. PATENT DOCUMENTS 5,735,065 A 4/1998 Yamagata et al.
5,835,874 A 11/1998 Hirata et al.
(Continued)

FOREIGN PATENT DOCUMENTS

CN 1210570 A 3/1999
CN 103827400 A 5/2014
(Continued)

OTHER PUBLICATIONS

International Search Report and Written Opinion mailed Oct. 7, 2014, issued for PCT/JP2014/064544.

*Primary Examiner* — Maceeh Anwari
(74) *Attorney, Agent, or Firm* — Locke Lord LLP

(57) ABSTRACT

A control method controlling a work machine including a working unit with a working tool, comprising: obtaining a position of the working unit based on a detected position information item of the work machine and generating a target excavation ground shape information item indicating a target shape of an excavation target of the working unit from an information item of a design face indicating the target shape; and performing an excavation control of restraining the working unit from performing an excavation beyond the target shape based on the target excavation ground shape information item and, when the target excavation ground shape information item is not able to be acquired during the excavation control, continuing the excavation control by storing the target excavation ground shape information item obtained before a time point at which the target excavation ground shape information item is not able to be acquired, for a predetermined time.

10 Claims, 14 Drawing Sheets

(51) Int. Cl.

| | |
|---|---|
| ***G06G 7/00*** | (2006.01) |
| ***G06G 7/76*** | (2006.01) |
| ***E02F 3/43*** | (2006.01) |
| ***E02F 9/26*** | (2006.01) |
| *E02F 3/32* | (2006.01) |

(58) Field of Classification Search
USPC ..... 701/50
See application file for complete search history.

(56) References Cited

U.S. PATENT DOCUMENTS

| | | | |
|---|---|---|---|
| 2002/0169545 | A1 | 11/2002 | Toyooka |
| 2011/0004379 | A1 | 1/2011 | Murota |
| 2014/0200776 | A1 | 7/2014 | Matsuyama et al. |

FOREIGN PATENT DOCUMENTS

| | | | |
|---|---|---|---|
| EP | 0900887 | A1 | 3/1999 |
| JP | 2002-341010 | A | 11/2002 |
| JP | 2005-134015 | A | 5/2005 |
| JP | 2006-265954 | A | 10/2006 |
| JP | 2009-197438 | A | 9/2009 |
| JP | 2009-229224 | A | 10/2009 |
| JP | 2013-217138 | A | 10/2013 |
| WO | WO-95/30059 | A1 | 11/1995 |

WORK MACHINE CONTROL SYSTEM, WORK MACHINE, EXCAVATOR CONTROL SYSTEM, AND WORK MACHINE CONTROL METHOD

FIELD

The present invention relates to a work machine control system including a working unit, a work machine, an excavator control system, and a work machine control method.

BACKGROUND

Conventionally, in a construction machine including a front device with a bucket, there is proposed an excavation control in which a bucket is moved along a boundary face indicating a target shape of an excavation target (for example, see Patent Literature 1).

CITATION LIST

Patent Literature

Patent Literature 1: WO 95/30059 A

SUMMARY

Technical Problem

In an excavation control, a boundary face indicating a target shape of an excavation target is generated based on, for example, a position information item of a work machine based on a position data item received from a positioning satellite or the like. For this reason, when the position information item of the work machine cannot be received or the like, the excavation control cannot be continued and hence there is a case in which the excavation control stops. In this case, operation by an operator of the work machine is needed in order to perform the excavation control again, and the burden of the operator increases.

An object of the invention is to reduce a burden of an operator when a work machine including a working unit performs an excavation control.

Solution to Problem

According to the present invention, a work machine control system that controls a work machine including a working unit with a working tool, the work machine control system comprises: a position detection device that detects a position information item of the work machine; a generation unit that obtains a position of the working unit based on the position information item detected by the position detection device and generates a target excavation ground shape information item indicating a target shape of an excavation target of the working unit from an information item of a target construction face indicating the target shape; and a working unit control unit that performs an excavation control of controlling a velocity in a direction in which the working unit approaches the excavation target so that the velocity becomes equal to or less than a limitation velocity based on the target excavation ground shape information item acquired from the generation unit, wherein when the working unit control unit is not able to acquire the target excavation ground shape information item during the excavation control, the working unit control unit continues the excavation control by using the target excavation ground shape information item obtained before a time point at which the working unit control unit is not able to acquire the target excavation ground shape information item.

In the present invention, it is preferable that wherein the working unit control unit stores the target excavation ground shape information item obtained before the time point at which the working unit control unit is not able to acquire the target excavation ground shape information item for a predetermined time, and wherein the working unit control unit ends the excavation control being currently performed by ending the storage of the target excavation ground shape information item when the predetermined time elapses, the work machine travels, or a swing body to which the working unit is attached swings.

In the present invention, it is preferable that the work machine control system, comprises: a swing angle detection device that detects a swing angle of the swing body, and wherein when the swing angle detected by the swing angle detection device is equal to or more than a predetermined magnitude, the working unit control unit ends the storage of the target excavation ground shape information item to end the excavation control being currently performed.

In the present invention, it is preferable that the working unit control unit updates the stored target excavation ground shape information item by using an inclination angle detected by a device that obtains the inclination angle of the work machine.

In the present invention, it is preferable that when the working unit control unit acquires the target excavation ground shape information item which is new before a predetermined time elapses, the working unit control unit starts the excavation control by using the acquired target excavation ground shape information item.

In the present invention, it is preferable that when the working unit control unit acquires the target excavation ground shape information item which is new after ending the excavation control being currently performed, the working unit control unit starts the excavation control by using the acquired target excavation ground shape information item.

According to the present invention, an excavator control system that controls a work machine including a working unit with a working tool, the excavator control system comprises: a position detection device that detects a position information item of the work machine; a generation unit that obtains a position of the working unit based on the position information item detected by the position detection device and generates a target excavation ground shape information item indicating a target shape of an excavation target of the working unit from an information item of a design face indicating the target shape; and a working unit control unit that performs an excavation control of restraining the working unit from performing an excavation beyond the target shape based on the target excavation ground shape information item acquired from the generation unit, wherein when the position detection device is not able to detect the position information item of the work machine during the excavation control, the working unit control unit continues the excavation control by storing the target excavation ground shape information item obtained before a time point at which the position information item is not able to be detected, for a predetermined time, and wherein the working unit control unit ends the excavation control being currently performed by ending the storage of the target excavation ground shape information item when the predetermined time elapses, the working unit travels, or the working unit swings.

According to the present invention, a work machine comprises: the work machine control system.

According to the present invention, a work machine control method that controls a work machine including a working unit with a working tool, the work machine control method comprises: detecting a position information item of the work machine; obtaining a position of the working unit based on the detected position information item and generating a target excavation ground shape information item indicating a target shape of an excavation target of the working unit from an information item of a design face indicating the target shape; and performing an excavation control of restraining the working unit from performing an excavation beyond the target shape based on the target excavation ground shape information item and, when the target excavation ground shape information item is not able to be acquired during the excavation control, continuing the excavation control by storing the target excavation ground shape information item obtained before a time point at which the target excavation ground shape information item is not able to be acquired, for a predetermined time.

The invention can reduce a burden of an operator when the work machine including the working unit performs the excavation control.

DESCRIPTION OF EMBODIMENTS

A mode for carrying out the present invention (an embodiment) will be described in detail with reference to the drawings.

<Entire Configuration of Work Machine>

Figure 1:
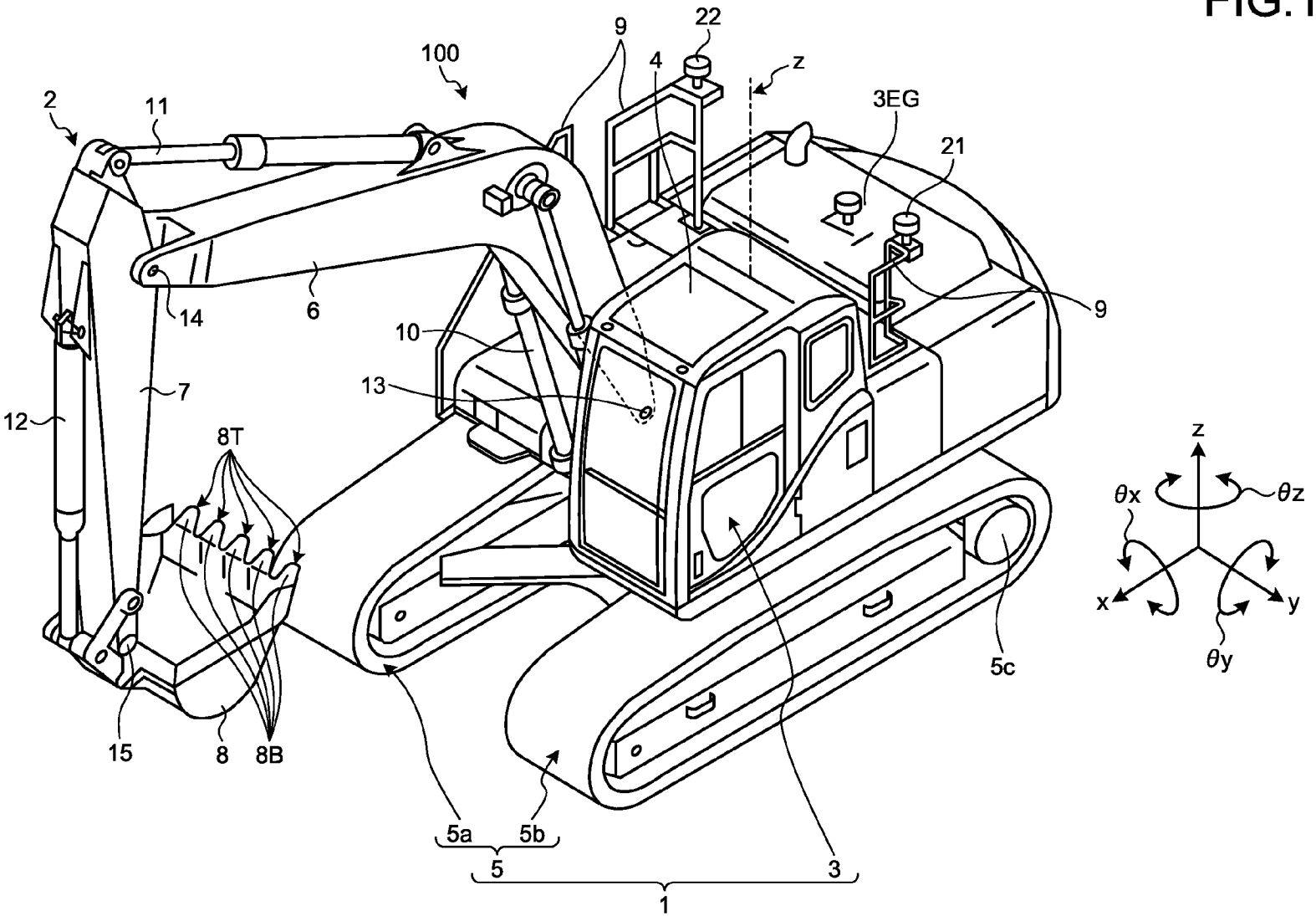
FIG. 1 is a perspective view of a work machine according to an embodiment.
Figure 2:
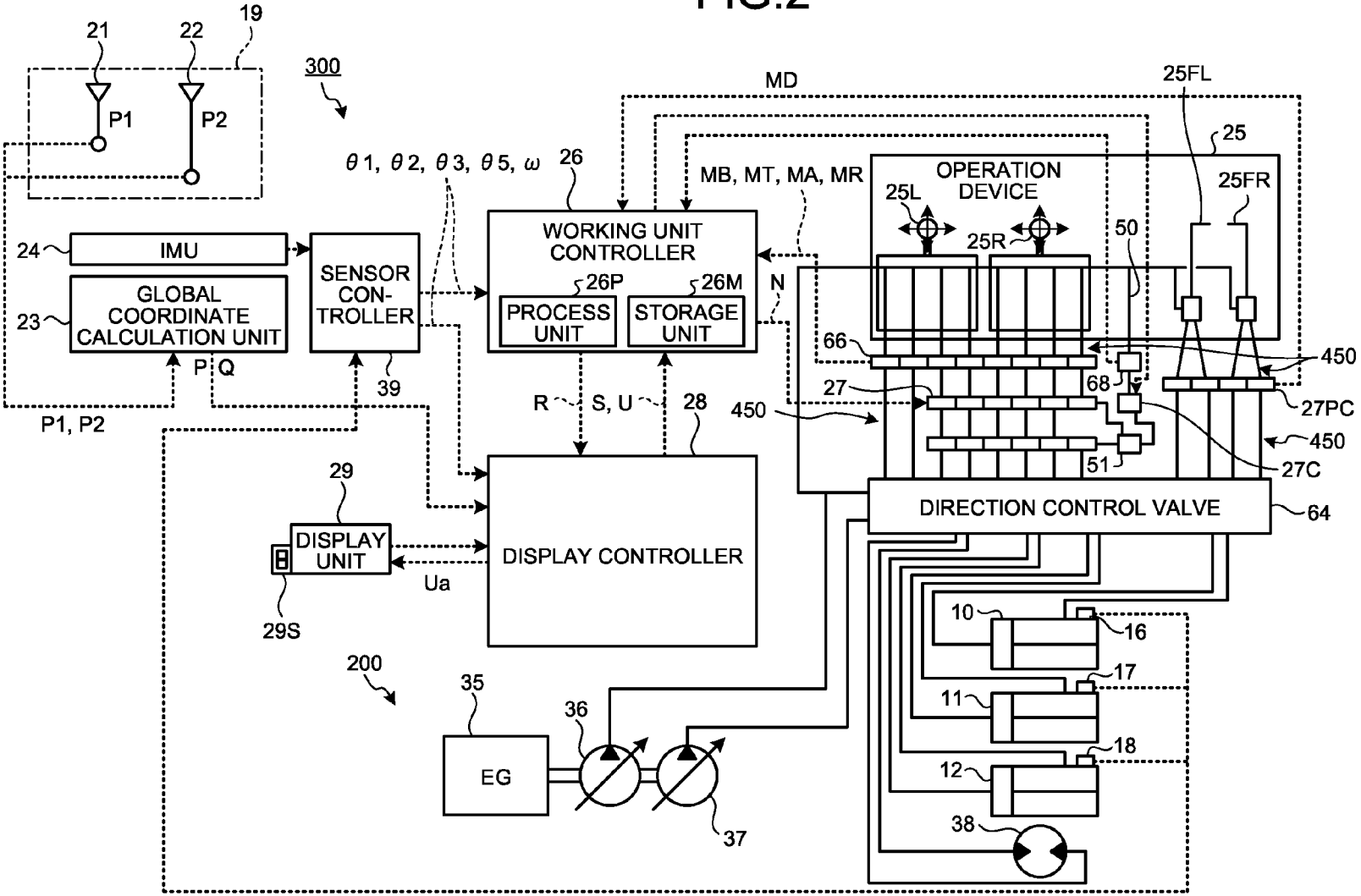
FIG. 2 is a block diagram illustrating configurations of a drive system and a control system of an excavator.

FIG. 1 is a perspective view of a work machine according to an embodiment. FIG. 2 is a block diagram illustrating configurations of a hydraulic system 300 and a control system 200 of an excavator 100. The excavator 100 as the work machine includes a vehicle body 1 as a main body and a working unit 2. The vehicle body 1 includes an upper swing body 3 as a swing body and a traveling device 5 as a traveling body. The upper swing body 3 accommodates devices such as an engine and a hydraulic pump as a power generation device inside an engine room 3EG. The engine room 3EG is disposed at one end side of the upper swing body 3.

In the embodiment, the excavator 100 uses, for example, an internal combustion engine such as a diesel engine for the engine as the power generation device, but the power generation device is not limited thereto. The power generation device of the excavator 100 may be, for example, a so-called hybrid-type device having a combination of an internal combustion engine, a generator motor, and an electrical storage device. Furthermore, the power generation device of the excavator 100 may be a device having a combination of the electrical storage device and the generator motor without the internal combustion engine.

The upper swing body 3 includes an operation room 4. The operation room 4 is installed at the other end side of the upper swing body 3. That is, the operation room 4 is installed at the opposite side to the side where the engine room 3EG is disposed. A display unit 29 and an operation device 25 illustrated in FIG. 2 are disposed inside the operation room 4. These will be described later. A handrail 9 is attached to the upper side of the upper swing body 3.

The traveling device 5 has the upper swing body 3 mounted thereon. The traveling device 5 includes crawler tracks 5*a* and 5*b*. The traveling device 5 causes the excavator 100 to travel in a manner such that one or both right and left traveling motors 5*c* are driven to rotate the crawler tracks 5*a* and 5*b*. The working unit 2 is attached to the lateral side of the operation room 4 of the upper swing body 3.

The excavator 100 may include a traveling device that includes tires instead of the crawler tracks 5*a* and 5*b* and that is capable of traveling by transmitting a drive force of an engine to the tires through a transmission. As the excavator 100 in such a mode, for example, there is a wheel-type excavator. Furthermore, the excavator 100 may be, for example, a backhoe loader which includes a traveling device with such tires, further has a working unit attached to a vehicle body (a main body) and has a structure that does not include the upper swing body 3 and a swing mechanism thereof illustrated in FIG. 1. That is, the backhoe loader is a backhoe loader having the working unit attached to the vehicle body and including the traveling device that forms a part of the vehicle body.

In the upper swing body 3, the side where the working unit 2 and the operation room 4 are disposed is the front side, and the side where the engine room 3EG is disposed is the rear side (the x direction). The left side in face of the front side is the left side of the upper swing body 3, and the right side in face of the front side is the right side of the upper swing body 3. The right and left direction of the upper swing body 3 will also be referred to as the width direction (the y direction). In the excavator 100 or the vehicle body 1, the traveling device 5 side based on the upper swing body 3 is the lower side, and the upper swing body 3 side based on the traveling device 5 is the upper side (the z direction). In the case where the excavator 100 is installed on the horizontal plane, the lower side is the side in the vertical direction, that is, the gravity action direction, and the upper side is the opposite side to the vertical direction.

The working unit 2 includes a boom 6, an arm 7, a bucket 8 as a working tool, a boom cylinder 10, an arm cylinder 11, and a bucket cylinder 12. A base end of the boom 6 is rotatably attached to the front portion of the vehicle body 1 through a boom pin 13. The base end of the arm 7 is rotatably attached to a front end of the boom 6 through an arm pin 14. The bucket 8 is attached to a front end of the arm 7 through a bucket pin 15. The bucket 8 rotates about the bucket pin 15. In the bucket 8, a plurality of blades 8B is attached to the opposite side to the bucket pin 15. Blade tips 8T are tips of the blades 8B.

The bucket 8 may not include the plurality of blades 8B. That is, the bucket 8 may be a bucket which does not include the blades 8B illustrated in FIG. 1 and which has the blade tips formed in a straight shape by a steel plate. The working unit 2 may include, for example, a tilting bucket with a single blade. The tilting bucket refers to a bucket which includes a bucket tilting cylinder and can shape and level an inclined or flat ground in a free fashion by tilting the bucket to the right and left even when the excavator is on an inclined ground surface and also can perform surface compaction work by using a bottom plate. In addition, the working unit 2 may include, for example, a slope finishing bucket or a rock drilling arm attachment with a rock drilling arm tip instead of the bucket 8.

Each of the boom cylinder 10, the arm cylinder 11, and the bucket cylinder 12 illustrated in FIG. 1 is a hydraulic cylinder which is driven by the pressure of the working oil (hereinafter, appropriately referred to as a hydraulic pressure). The boom cylinder 10 drives the boom 6 and moves the boom upward. The arm cylinder 11 drives the arm 7 and rotates the arm about the arm pin 14. The bucket cylinder 12 drives the bucket 8 and rotates the bucket about the bucket pin 15.

A direction control valve 64 illustrated in FIG. 2 is provided between the hydraulic cylinders such as the boom cylinder 10, the arm cylinder 11, and the bucket cylinder 12 and hydraulic pumps 36 and 37 illustrated in FIG. 2. The direction control valve 64 controls the flow amount of the working oil supplied from the hydraulic pumps 36 and 37 to the boom cylinder 10, the arm cylinder 11, the bucket cylinder 12 and the like and also changes the direction in which the working oil flows. The direction control valve 64 includes a traveling direction control valve which drives the traveling motor 5*c* and a working unit direction control valve which controls the boom cylinder 10, the arm cylinder 11, and the bucket cylinder 12 and controls a swing motor that causes the upper swing body 3 to swing.

When the working oil supplied from the operation device 25 and adjusted to a predetermined pilot pressure operates a spool of the direction control valve 64, the flow amount of the working oil flowing from the direction control valve 64 is adjusted, and the flow amount of the working oil supplied from the hydraulic pumps 36 and 37 to the boom cylinder 10, the arm cylinder 11, the bucket cylinder 12, the swing motor, or the traveling motor 5*c* is controlled. As a result, the operation of the boom cylinder 10, the arm cylinder 11, the bucket cylinder 12 and the like is controlled.

Furthermore, since the pilot pressure of the working oil supplied from the operation device 25 to the direction control valve 64 is controlled in a manner such that a working unit controller 26 illustrated in FIG. 2 controls a control valve 27 illustrated in FIG. 2, the flow amount of the working oil supplied from the direction control valve 64 to the boom cylinder 10, the arm cylinder 11, the bucket cylinder 12, the swing motor, or the traveling motor 5*c* is controlled. As a result, the working unit controller 26 can control the operation of the boom cylinder 10, the arm cylinder 11, the bucket cylinder 12 and the like.

Antennas 21 and 22 are attached to an upper portion of the upper swing body 3. The antennas 21 and 22 are used to detect the current position of the excavator 100. As illustrated in FIG. 2, the antennas 21 and 22 are electrically connected to a position detection device 19 as a position detection unit that detects the current position of the excavator 100. The position detection device 19 detects the current position of the excavator 100 by using RTK-GNSS (RealTime Kinematic-Global Navigation Satellite Systems; GNSS refers to a global navigation satellite system). Hereinafter, the antennas 21 and 22 will be appropriately referred to as the GNSS antennas 21 and 22. A signal responding to the GNSS radio wave received by the GNSS antennas 21 and 22 is input to the position detection device 19. The position detection device 19 detects installation positions of the GNSS antennas 21 and 22. The position detection device 19 includes, for example, a three-dimensional position sensor.

As illustrated in FIG. 1, it is desirable to install the GNSS antennas 21 and 22 at both end positions separated from each other in the right and left direction of the excavator 100 on the upper swing body 3. In the embodiment, the GNSS antennas 21 and 22 are attached to the handrails 9 attached at both sides in the width direction of the upper swing body 3, respectively. The attachment positions of the GNSS antennas 21 and 22 in the upper swing body 3 are not limited to the handrails 9, but it is desirable to install the GNSS antennas 21 and 22 at positions separated from each other as much as possible because the detection precision of the current position of the excavator 100 improves. Furthermore, it is desirable to install the GNSS antennas 21 and 22 at positions where the eyesight of the operator is not disturbed as much as possible.

As illustrated in FIG. 2, the hydraulic system 300 of the excavator 100 includes an engine 35 and the hydraulic pumps 36 and 37 as the power generation source. The hydraulic pumps 36 and 37 are driven by the engine 35 and eject the working oil. The working oil which is ejected from the hydraulic pumps 36 and 37 is supplied to the boom cylinder 10, the arm cylinder 11, and the bucket cylinder 12. Furthermore, the excavator 100 includes a swing motor 38. The swing motor 38 is a hydraulic motor, and is driven by the working oil ejected from the hydraulic pumps 36 and 37. The swing motor 38 causes the upper swing body 3 to swing.

Note that two hydraulic pumps 36 and 37 are illustrated in FIG. 2, but only one hydraulic pump may be provided. The swing motor 38 is not limited to the hydraulic motor, and may also be an electric motor.

The control system 200 as the work machine control system includes the position detection device 19, a global coordinate calculation unit 23, an IMU (Inertial Measurement Unit) 24 as a detection device that detects an angular velocity and an acceleration, the operation device 25, the working unit controller 26 as a working unit control unit, a sensor controller 39, a display controller 28 as a generation unit, and the display unit 29. The operation device 25 is a device that operates the working unit 2 illustrated in FIG. 1. The operation device 25 receives operator's operation of driving the working unit 2 and outputs a pilot hydraulic pressure responding to the operation amount.

For example, the operation device 25 includes a left operation lever 25L which is installed at the left side of the operator and a right operation lever 25R which is disposed at the right side of the operator. In the left operation lever 25L and the right operation lever 25R, the operation in the front to back direction and the right and left direction corresponds to the operation of two shafts. For example, the operation in the front to back direction of the right operation lever 25R corresponds to the operation of the boom 6. The boom 6 moves downward when the right operation lever 25R is operated forward, and the boom 6 moves upward when the right operation lever is operated backward. The operation of upward and downward movement of the boom 6 is performed in response to the operation in the front to back direction. The operation in the right and left direction of the right operation lever 25R corresponds to the operation of the bucket 8. The bucket 8 excavates when the right operation lever 25R is operated leftward, and the bucket 8 dumps when the right operation lever is operated rightward. The excavation operation or the opening operation of the bucket 8 is performed in response to the operation in the right and left direction. The operation in the front to back direction of the left operation lever 25L corresponds to the operation of the arm 7. The arm 7 dumps when the left operation lever 25L is operated forward, and the arm 7 excavates when the left operation lever is operated backward. The operation in the right and left direction of the left operation lever 25L corresponds to the swing of the upper swing body 3. The upper swing body swings leftward when the left operation lever 25L is operated leftward, and the upper swing body swings rightward when the left operation lever is operated rightward.

In the present embodiment, the upward movement operation of the boom 6 is equivalent to the dumping operation. The downward movement operation of the boom 6 is equivalent to the excavation operation. The excavation operation of the arm 7 is equivalent to the downward movement operation. The dumping operation of the arm 7 is equivalent to the upward movement operation. The excavation operation of the bucket 8 is equivalent to the downward movement operation. The dumping operation of the bucket 8 is equivalent to the upward movement operation. Note that the downward movement operation of the arm 7 may also be referred to as bending operation. The upward movement operation of the arm 7 may also be referred to as extension operation.

In the present embodiment, a pilot hydraulic type is used in the operation device 25. The working oil which is depressurized to a predetermined pilot pressure by a depressurization valve (not illustrated) is supplied from the hydraulic pump 36 to the operation device 25 based on the boom operation, the bucket operation, the arm operation, and the swing operation.

A pilot hydraulic pressure can be supplied to a pilot passageway 450 in response to the operation in the front to back direction of the right operation lever 25R, and the operation of the boom 6 by the operator is received. The valve device that is included in the right operation lever 25R opens in response to the operation amount of the right operation lever 25R, and the working oil is supplied to the pilot passageway 450. Furthermore, a pressure sensor 66 detects the pressure of the working oil inside the pilot passageway 450 at that time as the pilot pressure. The pressure sensor 66 transmits the detected pilot pressure as a boom operation amount MB to the working unit controller 26. Hereinafter, the operation amount in the front to back direction of the right operation lever 25R will be appropriately referred to as the boom operation amount MB. A pressure sensor 68, a control valve (hereinafter, appropriately referred to as an interposition valve) 27C, and a shuttle valve 51 are provided in a pilot passageway 50 between the operation device 25 and the boom cylinder 10. The interposition valve 27C and the shuttle valve 51 will be described later.

A pilot hydraulic pressure can be supplied to the pilot passageway 450 in response to the operation in the right and left direction of the right operation lever 25R, and the operation of the bucket 8 by the operator is received. The valve device that is included in the right operation lever 25R opens in response to the operation amount of the right operation lever 25R, and the working oil is supplied to the pilot passageway 450. Furthermore, the pressure sensor 66 detects the pressure of the working oil inside the pilot passageway 450 at that time as the pilot pressure. The pressure sensor 66 transmits the detected pilot pressure as a bucket operation amount MT to the working unit controller 26. Hereinafter, the operation amount in the right and left direction of the right operation lever 25R will be appropriately referred to as the bucket operation amount MT.

A pilot hydraulic pressure can be supplied to the pilot passageway 450 in response to the operation in the front to back direction of the left operation lever 25L, and the operation of the arm 7 by the operator is received. The valve device that is included in the left operation lever 25L opens in response to the operation amount of the left operation lever 25L, and the working oil is supplied to the pilot passageway 450. Furthermore, the pressure sensor 66 detects the pressure of the working oil inside the pilot passageway 450 at that time as the pilot pressure. The pressure sensor 66 transmits the detected pilot pressure as an arm operation amount MA to the working unit controller 26. Hereinafter, the operation amount in the right and left direction of the left operation lever 25L will be appropriately referred to as the arm operation amount MA.

A pilot hydraulic pressure can be supplied to the pilot passageway 450 in response to the operation in the right and left direction of the left operation lever 25L, and the operation of the upper swing body 3 by the operator is received. The valve device that is included in the left operation lever 25L opens in response to the operation amount of the left operation lever 25L, and the working oil is supplied to the pilot passageway 450. Furthermore, the pressure sensor 66 detects the pressure of the working oil inside the pilot passageway 450 at that time as the pilot pressure. The pressure sensor 66 transmits the detected pilot pressure as a swing operation amount MR to the working unit controller 26. Hereinafter, the operation amount in the front to back direction of the left operation lever 25L will be appropriately referred to as the swing operation amount MR.

The operation device 25 supplies a pilot hydraulic pressure of a magnitude responding to the operation amount of the right operation lever 25R to the direction control valve 64 in a manner such that the right operation lever 25R is operated. The operation device 25 supplies a pilot hydraulic pressure of a magnitude responding to the operation amount of the left operation lever 25L to the control valve 27 in a manner such that the left operation lever 25L is operated. The spool of the direction control valve 64 is operated by the pilot hydraulic pressure.

The pilot passageway 450 is provided with the control valve 27. The operation amounts of the right operation lever 25R and the left operation lever 25L are detected by the pressure sensor 66 provided in the pilot passageway 450. The pilot hydraulic pressure detected by the pressure sensor 66 is input to the working unit controller 26. The working unit controller 26 outputs a control signal N of the pilot passageway 450 responding to the input pilot hydraulic pressure to the control valve 27, and opens and closes the pilot passageway 450.

The operation device 25 includes traveling levers 25FL and 25FR. In the present embodiment, since a pilot hydraulic type is used in the operation device 25, the depressurized working oil is supplied from the hydraulic pump 36 to the direction control valve 64, and the spool of the direction control valve is driven based on the pressure of the working oil within the pilot passageway 450. Then, the working oil is supplied from the hydraulic pump to a traveling device (a hydraulic motor) not illustrated, and traveling becomes possible. The pressure of the working oil within the pilot passageway 450 is detected by a pressure sensor 27PC.

Traveling operation detection units 25PL and 25PR receive the operation of the traveling device 5 by the operator in response to the operation amount of the traveling levers 25FL and 25FR. The traveling operation detection units receive the operation of the traveling device 5, specifically, the crawler tracks 5*a* and 5*b* by the operator. The stepping amount of the traveling levers 25FL and 25FR is detected by the pressure sensor 27PC, and is output as an operation amount MD to the working unit controller 26.

The working unit 2 may be controlled in a manner such that the operation amounts of the left operation lever 25L and the right operation lever 25R are detected by for example, a potentiometer and a hall IC and the working unit controller 26 controls the direction control valve 64 and the control valve 27 based on the detection values. In this way, the left operation lever 25L and the right operation lever 25R may be of an electric type. The swing operation and the arm operation may be replaced. In this case, the extension operation or the bending operation of the arm 7 is performed in response to the operation in the right and left direction of the left operation lever 25L, and the swing operation in the right and left direction of the upper swing body 3 is performed in response to the operation in the front to back direction of the left operation lever 25L.

The control system 200 includes a first stroke sensor 16, a second stroke sensor 17, and a third stroke sensor 18. For example, the first stroke sensor 16 is provided in the boom cylinder 10, the second stroke sensor 17 is provided in the arm cylinder 11, and the third stroke sensor 18 is provided in the bucket cylinder 12. The first stroke sensor 16 detects the stroke length (hereinafter, appropriately referred to as a boom cylinder length LS1) of the boom cylinder 10. The first stroke sensor 16 detects a displacement amount corresponding to the extension of the boom cylinder 10, and outputs the displacement amount to the sensor controller 39. The sensor controller 39 calculates the cylinder length LS1 of the boom cylinder 10 corresponding to the displacement amount of the first stroke sensor 16. The sensor controller 39 calculates an inclination angle θ1 of the boom 6 with respect to the direction (the z direction) perpendicular to the horizontal plane in the local coordinate system of the excavator 100, specifically, the local coordinate system of the vehicle body 1 from the boom cylinder length LS1 detected by the first stroke sensor 16, and outputs the inclination angle to the working unit controller 26 and the display controller 28.

The second stroke sensor 17 detects the stroke length (hereinafter, appropriately referred to as an arm cylinder length LS2) of the arm cylinder 11. The second stroke sensor 17 detects a displacement amount corresponding to the extension of the arm cylinder 11, and outputs the displacement amount to the sensor controller 39. The sensor controller 39 calculates the cylinder length LS2 of the arm cylinder 11 corresponding to the displacement amount of the second stroke sensor 17.

The sensor controller 39 calculates an inclination angle θ2 of the arm 7 with respect to the boom 6 from the arm cylinder length LS2 detected by the second stroke sensor 17, and outputs the inclination angle to the working unit controller 26 and the display controller 28. The third stroke sensor 18 detects the stroke length (hereinafter, appropriately referred to as a bucket cylinder length LS3) of the bucket cylinder 12. The third stroke sensor 18 detects a displacement amount corresponding to the extension of the bucket cylinder 12, and outputs the displacement amount to the sensor controller 39. The sensor controller 39 calculates the cylinder length LS2 of the bucket cylinder 12 corresponding to the displacement amount of the third stroke sensor 18.

The sensor controller 39 calculates an inclination angle θ3 of the blade tip 8T of the bucket 8 included in the bucket 8 with respect to the arm 7 from the bucket cylinder length LS3 detected by the third stroke sensor 18, and outputs the inclination angle to the working unit controller 26 and the display controller 28. Other than the measurement of the inclination angle θ1, the inclination angle θ2, and the inclination angle θ3 of the boom 6, the arm 7, and the bucket 8 by the first stroke sensor 16 and the like, the inclination angles may be acquired by a rotary encoder which is attached to the boom 6 and measures the inclination angle of the boom 6, a rotary encoder which is attached to the arm 7 and measures the inclination angle of the arm 7, and a rotary encoder which is attached to the bucket 8 and measures the inclination angle of the bucket 8.

The working unit controller 26 includes a storage unit 26M such as a RAM (Random Access Memory) and a ROM (Read Only Memory) and a process unit 26P such as a CPU (Central Processing Unit). The working unit controller 26 controls the control valve 27 and the interposition valve 27C based on the detection value of the pressure sensor 66 illustrated in FIG. 2.

The direction control valve 64 illustrated in FIG. 2 is, for example, a proportional control valve, and is controlled by the working oil supplied from the operation device 25. The direction control valve 64 is disposed between the hydraulic actuators such as the boom cylinder 10, the arm cylinder 11, the bucket cylinder 12, and the swing motor 38 and the hydraulic pumps 36 and 37. The direction control valve 64 controls the flow amount of the working oil supplied from the hydraulic pumps 36 and 37 to the boom cylinder 10, the arm cylinder 11, the bucket cylinder 12, and the swing motor 38.

The position detection device 19 included in the control system 200 detects the position of the excavator 100. The position detection device 19 includes the above-described GNSS antennas 21 and 22. A signal responding to the GNSS radio wave received by the GNSS antennas 21 and 22 is input to the global coordinate calculation unit 23. The GNSS antenna 21 receives a reference position data item P1 indicating its own position from a positioning satellite. The GNSS antenna 22 receives a reference position data item P2 indicating its own position from the positioning satellite. The GNSS antennas 21 and 22 receive the reference position data items P1 and P2 at, for example, a frequency of 10 Hz. The reference position data items P1 and P2 are information items of the position where the GNSS antenna is installed. The GNSS antennas 21 and 22 are output to the global coordinate calculation unit 23 each time the reference position data items P1 and P2 are received.

The global coordinate calculation unit 23 acquires the two reference position data items P1 and P2 (a plurality of reference position data items) represented by the global coordinate system. The global coordinate calculation unit 23 generates a swing body arrangement data item indicating the arrangement of the upper swing body 3 based on the two reference position data items P1 and P2. In the present embodiment, the swing body arrangement data item includes one reference position data item P of the two reference position data items P1 and P2 and a swing body orientation data item Q generated based on the two reference position data items P1 and P2. The swing body orientation data item Q is determined based on an angle of the orientation determined from the reference position data item P acquired by the GNSS antennas 21 and 22 with respect to the reference orientation (for example, the north) of the global coordinate. The swing body orientation data item Q indicates the orientation in which the upper swing body 3, that is, the working unit 2 faces. The global coordinate calculation unit 23 updates the swing body arrangement data item, that is, the reference position data item P and the swing body orientation data item Q each time the two reference position data items P1 and P2 are acquired by the GNSS antennas 21 and 22 at, for example, a frequency of 10 Hz, and outputs the data item to the working unit controller 26 and the display controller 28.

The IMU 24 is attached to the upper swing body 3. The IMU 24 detects an operation data item indicating the operation of the upper swing body 3. The operation data item detected by the IMU 24 is, for example, acceleration and an angular velocity. In the embodiment, the operation data item is a swing angular velocity ω at which the upper swing body 3 swings about a swing axis z of the upper swing body 3 illustrated in FIG. 1. For example, the swing angular velocity ω is obtained by differentiating the swing angle of the upper swing body 3 detected by the IMU 24 by time. The swing angle of the upper swing body 3 may be acquired from the position information items of the GNSS antennas 21 and 22.

Figure 3A:
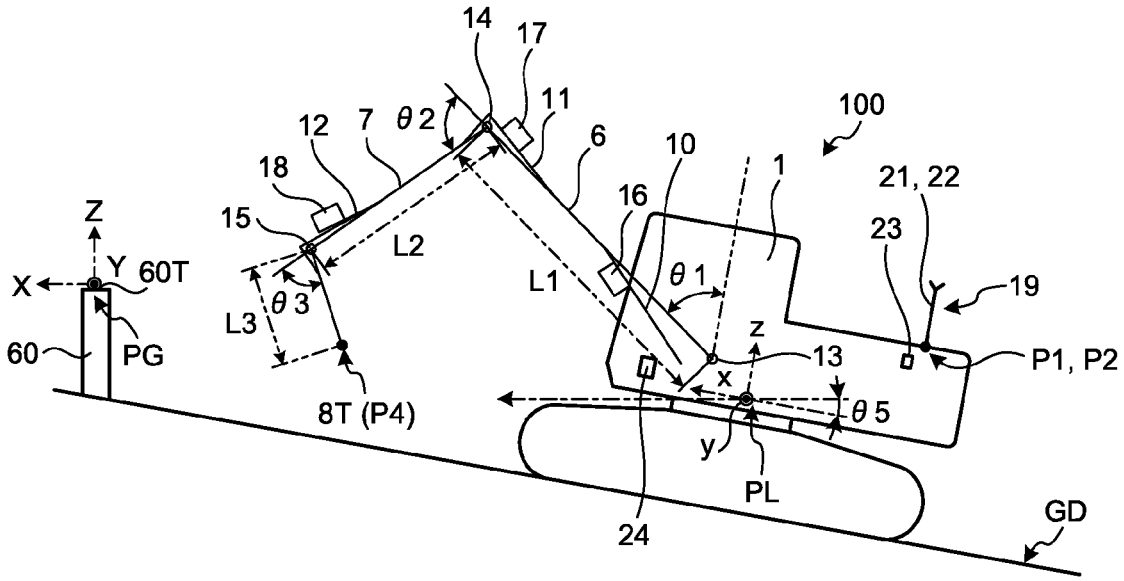
FIG. 3A is a side view of the excavator.
Figure 3B:
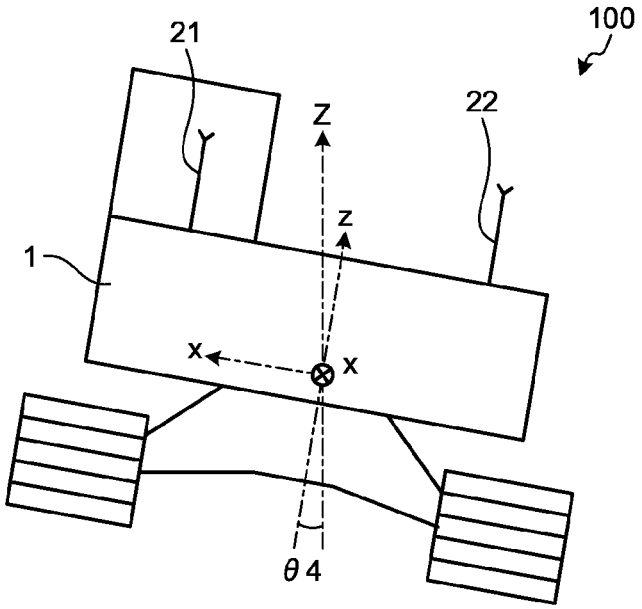
FIG. 3B is a rear view of the excavator.

FIG. 3A is a side view of the excavator 100. FIG. 3B is a rear view of the excavator 100. As illustrated in FIGS. 3A and 3B, the IMU 24 detects an inclination angle θ4 with respect to the right and left direction of the vehicle body 1, an inclination angle θ5 with respect to the front to back direction of the vehicle body 1, acceleration, and an angular velocity. The IMU 24 updates the swing angular velocity ω, the inclination angle θ4, and the inclination angle θ5 at, for example, a frequency of 100 Hz. It is desirable that an updating cycle in the IMU 24 be shorter than an updating cycle in the global coordinate calculation unit 23. The swing angular velocity ω and the inclination angle θ5 detected by the IMU 24 are output to the sensor controller 39. The sensor controller 39 subjects the swing angular velocity ω, the inclination angle θ4, and the inclination angle θ5 to a filter process or the like, and then outputs the swing angular velocity and the inclination angles to the working unit controller 26 and the display controller 28.

The display controller 28 acquires the swing body arrangement data item (the reference position data item P and the swing body orientation data item Q) from the global coordinate calculation unit 23. In the present embodiment, the display controller 28 generates a bucket blade tip position data item S indicating a three-dimensional position of the blade tip 8T of the bucket 8 as the working unit position data item. Then, the display controller 28 generates a target excavation ground shape data item U indicating a target shape of an excavation target by using the bucket blade tip position data item S and a target construction information item T to be described later. The display controller 28 derives a display target excavation ground shape data item Ua based on the target excavation ground shape data item U, and causes the display unit 29 to display a target excavation ground shape 43I based on the display target excavation ground shape data item Ua.

The display unit 29 is, for example, a liquid crystal display or the like, but is not limited thereto. In the embodiment, a switch 29S is installed near the display unit 29. The switch 29S is an input device used to perform an excavation control to be described below or stop an excavation control which is currently performed.

The working unit controller 26 acquires the swing angular velocity ω indicating the swing angular velocity ω at which the upper swing body 3 swings about the swing axis z illustrated in FIG. 1 from the sensor controller 39. Furthermore, the working unit controller 26 acquires a boom operation signal MB, a bucket operation signal MT, an arm operation signal MA, and a swing operation signal MR from the pressure sensor 66. The working unit controller 26 acquires the inclination angle θ1 of the boom 6, the inclination angle θ2 of the arm 7, and the inclination angle θ3 of the bucket 8 from the sensor controller 39.

The working unit controller 26 acquires the target excavation ground shape data item U from the display controller 28. The working unit controller 26 calculates a position of the blade tip 8T of the bucket 8 (hereinafter, appropriately referred to as a blade tip position) from the angle of the working unit 2 acquired from the sensor controller 39. The working unit controller 26 adjusts the boom operation amount MB, the bucket operation amount MT, and the arm operation amount MA input from the operation device 25 based on the distance between the target excavation ground shape data item U and the blade tip 8T of the bucket 8 and the velocity so that the blade tip 8T of the bucket 8 moves along the target excavation ground shape data item U. The working unit controller 26 generates the control signal N used for controlling the working unit 2 so that the blade tip 8T of the bucket 8 moves along the target excavation ground shape data item U, and outputs the control signal to the control valve 27 illustrated in FIG. 2. By such a process, the velocity at which the working unit 2 approaches the target excavation ground shape data item U is limited in response to the distance with respect to the target excavation ground shape data item U.

The two control valves 27 provided in each of the boom cylinder 10, the arm cylinder 11, and the bucket cylinder 12 open and close in response to the control signal N from the working unit controller 26. The spool of the direction control valve 64 is operated based on the operation of the left operation lever 25L or the right operation lever 25R and an opening/closing instruction of the control valve 27, and the working oil is supplied to the boom cylinder 10, the arm cylinder 11, and the bucket cylinder 12.

The global coordinate calculation unit 23 detects the reference position data items P1 and P2 of the GNSS antennas 21 and 22 in the global coordinate system. The global coordinate system is a three-dimensional coordinate system indicated by (X, Y, Z) which is based on, for example, a reference position PG of an alignment marker 60 serving as a reference installed in a working area GD of the excavator 100. As illustrated in FIG. 3A, the reference position PG is located at, for example, a tip 60T of the alignment marker 60 installed in the working area GD. In the present embodiment, the global coordinate system refers to, for example, a coordinate system in GNSS.

The display controller 28 illustrated in FIG. 2 calculates the position of the local coordinate system when viewed in the global coordinate system based on the detection result by the position detection device 19. The local coordinate system refers to a three-dimensional coordinate system indicated by (x, y, z) which is based on the excavator 100. In the present embodiment, a reference position PL of the local coordinate system is located on, for example, a swing circle used for the upper swing body 3 to swing. In the present embodiment, for example, the working unit controller 26 calculates the position of the local coordinate system when viewed in the global coordinate system as below.

The sensor controller 39 calculates the inclination angle θ1 of the boom 6 with respect to the direction (the z direction) perpendicular to the horizontal plane in the local coordinate system from the boom cylinder length detected by the first stroke sensor 16. The working unit controller 26 calculates the inclination angle θ2 of the arm 7 with respect to the boom 6 from the arm cylinder length detected by the second stroke sensor 17. The working unit controller 26 calculates the inclination angle θ3 of the bucket 8 with respect to the arm 7 from the bucket cylinder length detected by the third stroke sensor 18.

A storage unit 26M of the working unit controller 26 stores a data item of the working unit 2 (hereinafter, appropriately referred to as a working unit data item). The working unit data item includes a length L1 of the boom 6, a length L2 of the arm 7, and a length L3 of the bucket 8. As illustrated in FIG. 3A, the length L1 of the boom 6 is equivalent to the length from the boom pin 13 to the arm pin 14. The length L2 of the arm 7 is equivalent to the length from the arm pin 14 to the bucket pin 15. The length L3 of the bucket 8 is equivalent to the length from the bucket pin 15 to the blade tip 8T of the bucket 8. The blade tip 8T is the tip of the blade 8B illustrated in FIG. 1. Furthermore, the working unit data item includes the position information item to the boom pin 13 with respect to the reference position PL of the local coordinate system.

Figure 4:
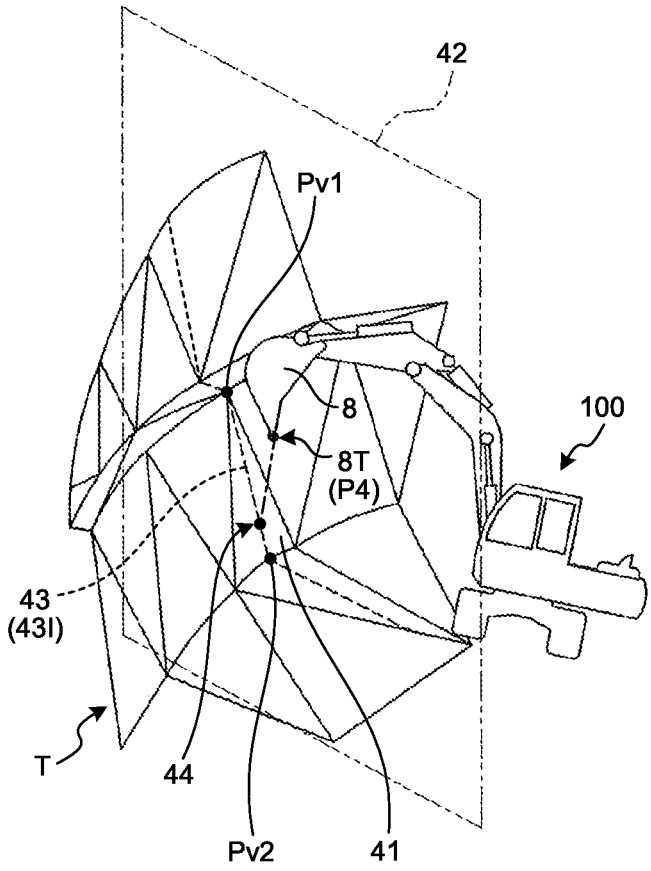
FIG. 4 is a schematic diagram illustrating an example of a target construction information item.

FIG. 4 is a schematic diagram illustrating an example of a target construction face. As illustrated in FIG. 4, the target construction information item T serving as a finish target after excavation of the excavation target of the working unit 2 included in the excavator 100 includes a plurality of target construction faces 41 respectively expressed by triangular polygons. In FIG. 4, only one of the plurality of target construction faces 41 is denoted by reference numeral 41, and the reference numerals of the other target construction faces 41 are omitted. The working unit controller 26 controls the velocity in a direction in which the working unit 2 approaches the excavation target so that the velocity is equal to or less than a limitation velocity in order to restrain the bucket 8 from eroding the target excavation ground shape 43I. This control will be appropriately referred to as an excavation control. Next, the excavation control that is performed by the working unit controller 26 will be described.

<Regarding Excavation Control>

Figure 5:
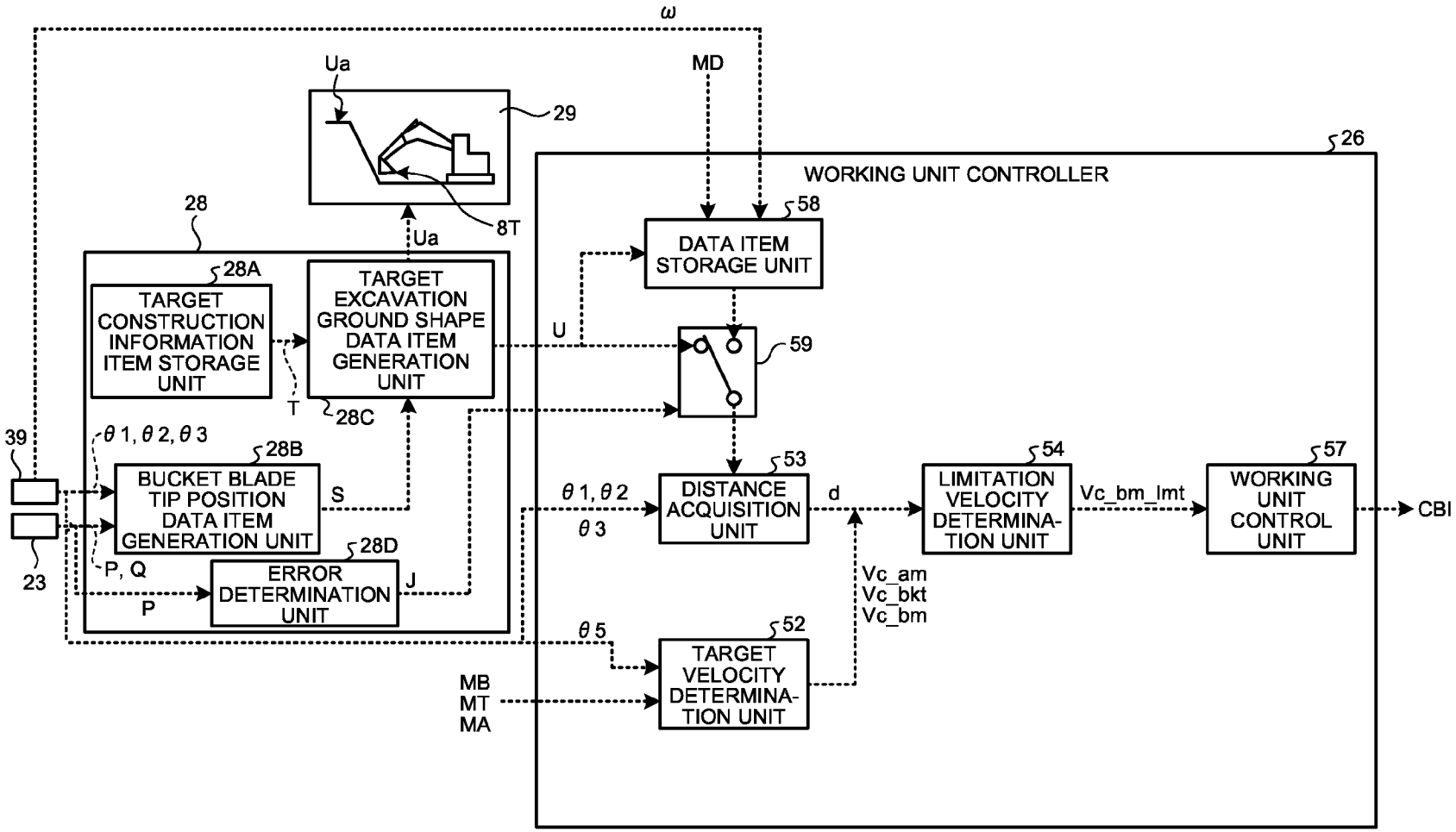
FIG. 5 is a block diagram illustrating a working unit controller and a display controller.
Figure 6:
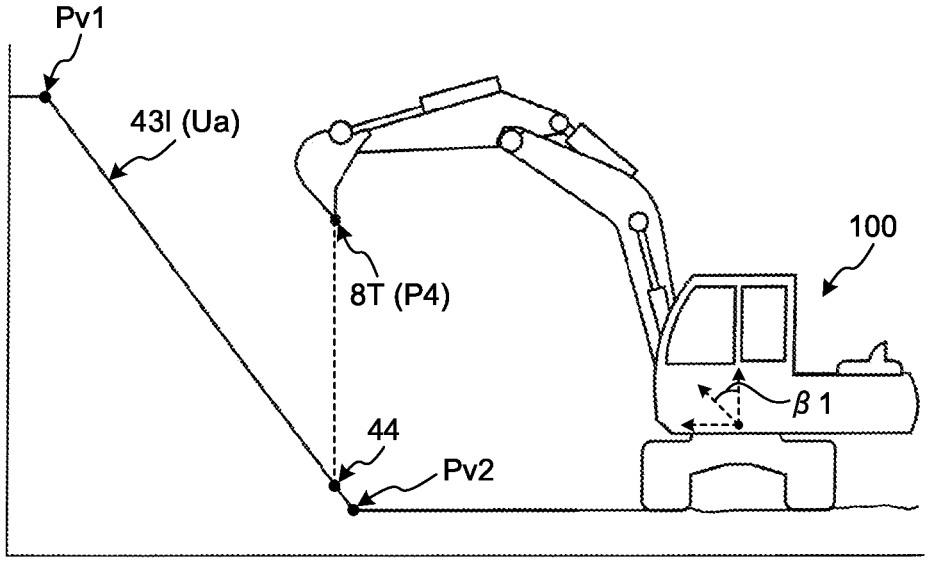
FIG. 6 is a diagram illustrating an example of a target excavation ground shape displayed on a display unit.
Figure 7:
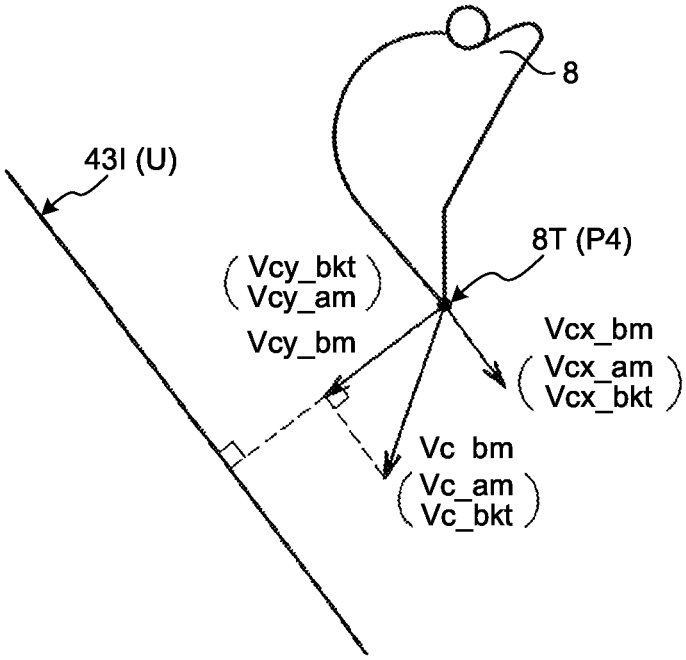
FIG. 7 is a schematic diagram illustrating a relation among a target velocity, a perpendicular velocity element, and a horizontal velocity element.
Figure 8:
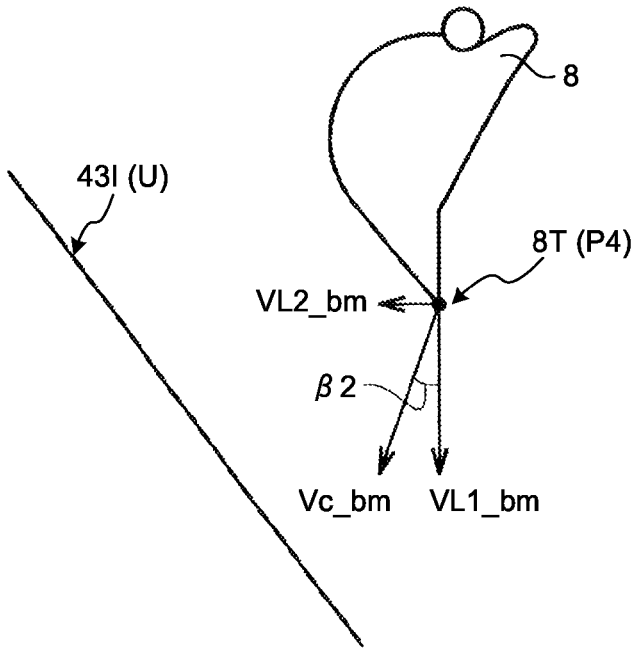
FIG. 8 is a diagram illustrating a calculation method of the perpendicular velocity element and the horizontal velocity element.
Figure 9:
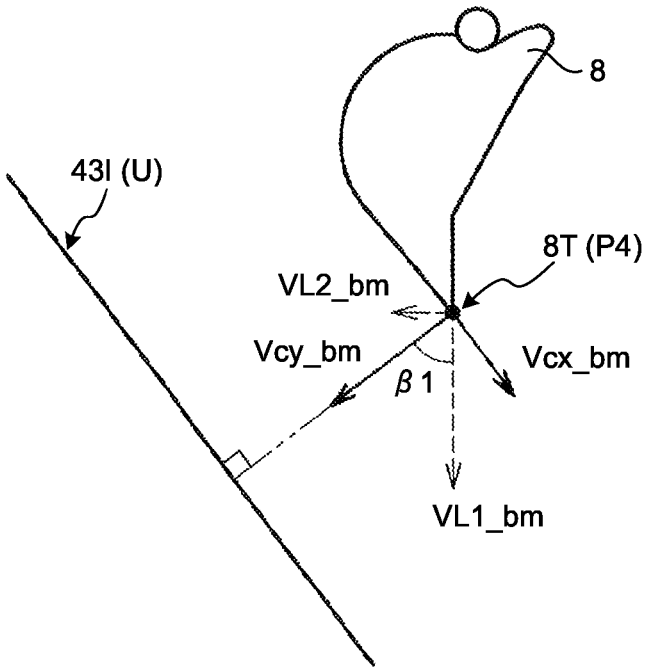
FIG. 9 is a diagram illustrating a calculation method of the perpendicular velocity element and the horizontal velocity element.
Figure 10:
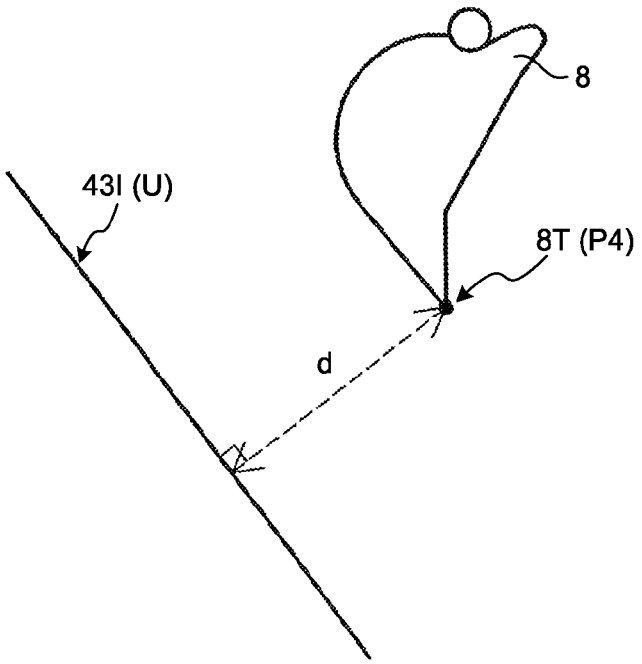
FIG. 10 is a schematic diagram illustrating a distance between a blade tip and a target excavation ground shape.
Figure 11:
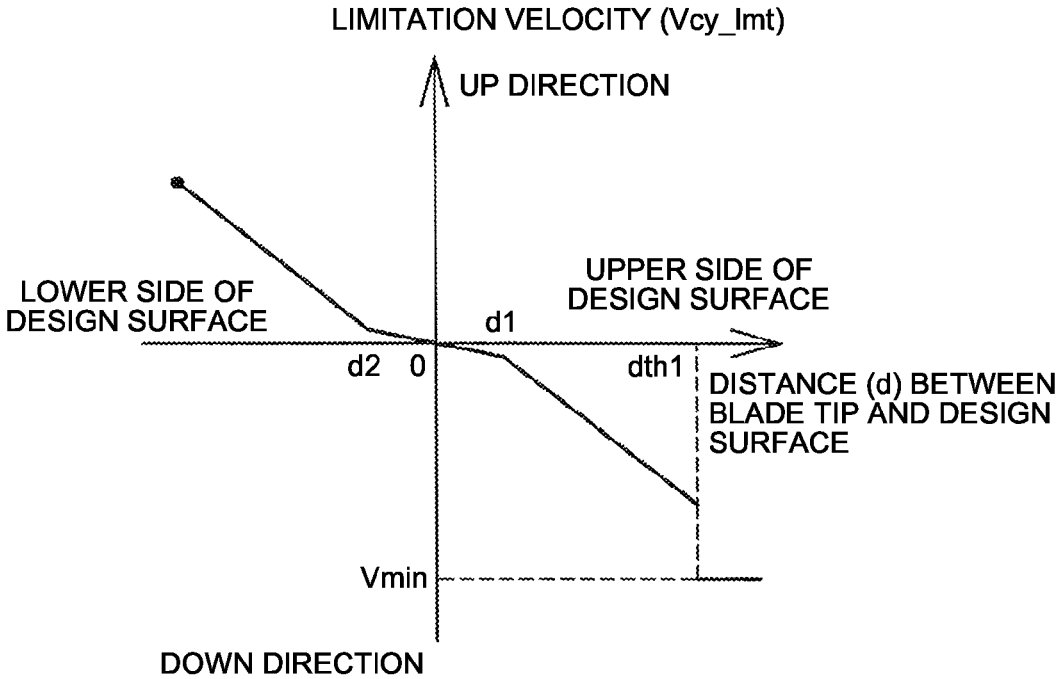
FIG. 11 is a graph illustrating an example of a limitation velocity information item.
Figure 12:
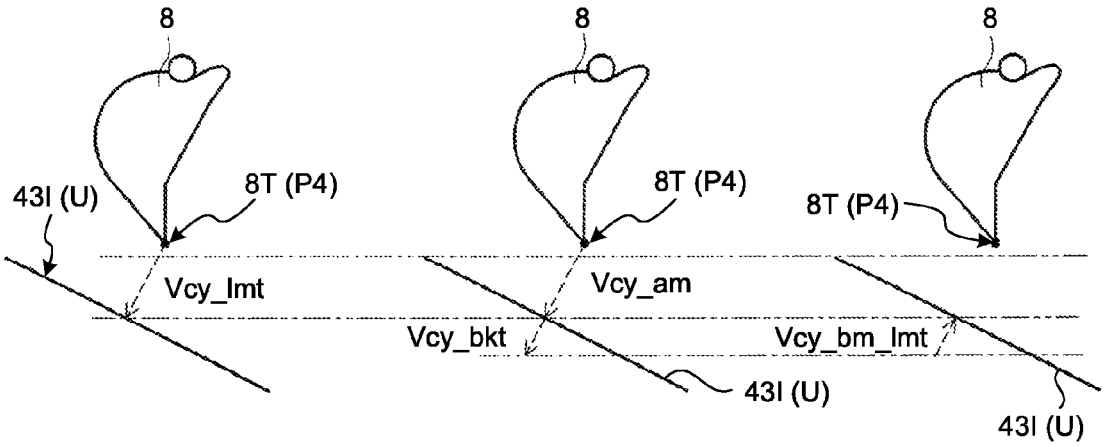
FIG. 12 is a schematic diagram illustrating a calculation method of a perpendicular velocity element of a limitation velocity of a boom.
Figure 13:
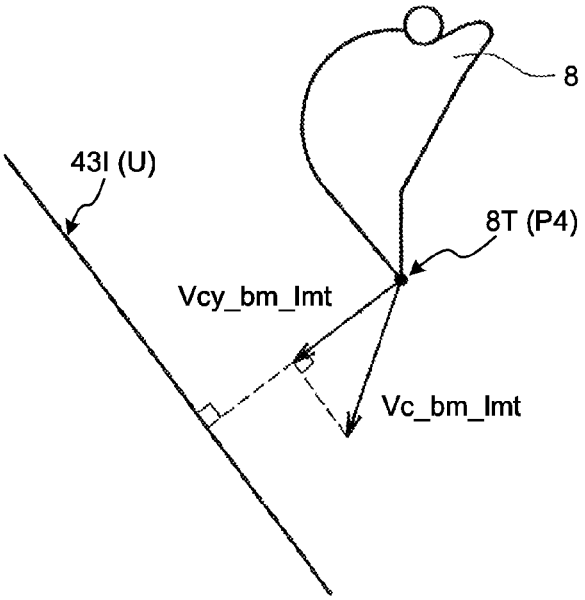
FIG. 13 is a schematic diagram illustrating a relation between the perpendicular velocity element of the limitation velocity of the boom and the limitation velocity of the boom.
Figure 14:
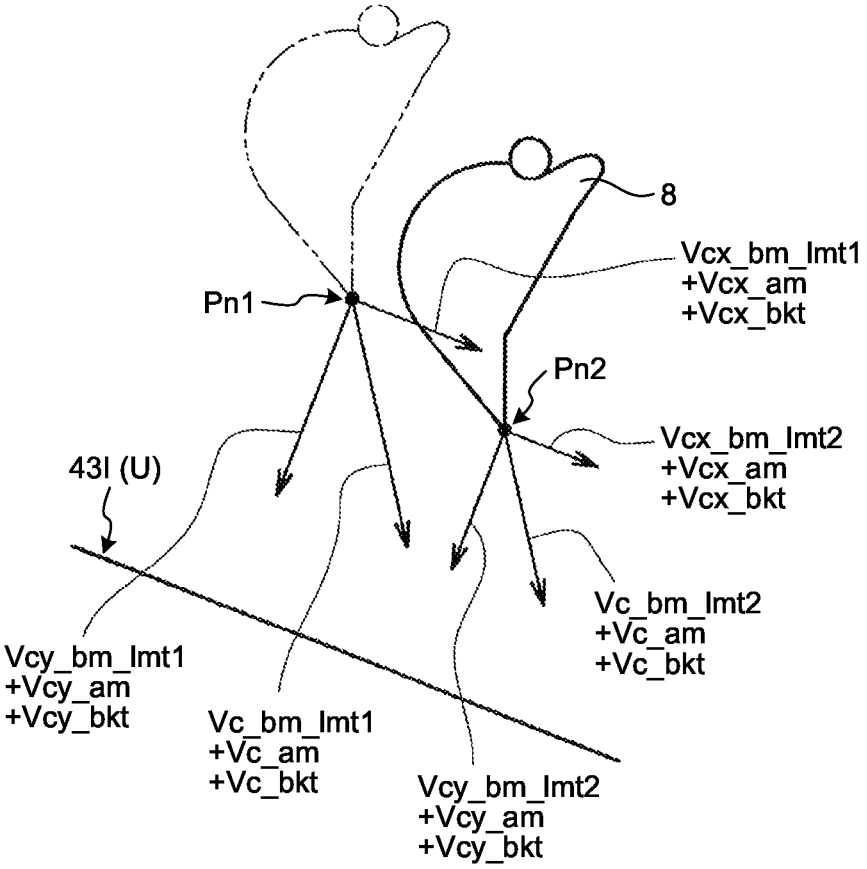
FIG. 14 is a diagram illustrating an example of a change in the limitation velocity of the boom due to the movement of the blade tip.

FIG. 5 is a block diagram illustrating the working unit controller 26 and the display controller 28. FIG. 6 is a diagram illustrating an example of the target excavation ground shape 43I displayed on the display unit. FIG. 7 is a schematic diagram illustrating a relation among a target velocity, a perpendicular velocity element, and a horizontal velocity element. FIG. 8 is a diagram illustrating a calculation method of the perpendicular velocity element and the horizontal velocity element. FIG. 9 is a diagram illustrating a calculation method of the perpendicular velocity element and the horizontal velocity element. FIG. 10 is a schematic diagram illustrating a distance between the blade tip and the target excavation ground shape 43I. FIG. 11 is a graph illustrating an example of a limitation velocity information item. FIG. 12 is a schematic diagram illustrating a calculation method of the perpendicular velocity element of a limitation velocity of the boom. FIG. 13 is a schematic diagram illustrating a relation between the perpendicular velocity element of the limitation velocity of the boom and the limitation velocity of the boom. FIG. 14 is a schematic diagram illustrating a deviation amount and a displacement amount of the blade tip.

As illustrated in FIGS. 4 and 5, the display controller 28 generates the target excavation ground shape data item U, and outputs the data item to the working unit controller 26. The excavation control is performed, for example, when the operator of the excavator 100 selects a state where the excavation control is performed by the switch 29S illustrated in FIG. 2. When the excavation control is performed, the working unit controller 26 generates a boom instruction signal CBI necessary for the excavation control by using the boom operation amount MB, the arm operation amount MA, the bucket operation amount MT, the target excavation ground shape data item U acquired from the display controller 28, and the inclination angles θ1, θ2, and θ3 acquired from the sensor controller 39, and furthermore generates an arm instruction signal and a bucket instruction signal if necessary, drives the control valve 27 and the interposition valve 27C, and controls the working unit 2.

First, the display controller 28 will be described. The display controller 28 includes a target construction information item storage unit 28A, a bucket blade tip position data item generation unit 28B, a target excavation ground shape data item generation unit 28C, and an error determination unit 28D. The target construction information item storage unit 28A stores the target construction information item T as an information item indicating the target shape in a working area. The target construction information item T includes a coordinate data item and an angle data item necessary for generating the target excavation ground shape data item U as an information item indicating the target shape of the excavation target. The target construction information item T includes a position information item of the plurality of target construction faces 41. The target construction information item T necessary for the excavation control working unit controller 26 to control the working unit 2 or necessary for displaying the target excavation ground shape data item Ua on the display unit 29 is downloaded to the target construction information item storage unit 28A via, for example, a wireless communication. Furthermore, the necessary target construction information item T may be downloaded to the target construction information item storage unit 28A by connecting a terminal device storing the target construction information item to the display controller 28, or may be transferred by connecting a separable storage device to the controller 28.

The bucket blade tip position data item generation unit 28B generates a swing center position data item XR indicating a position of the swing center of the excavator 100 passing through the swing axis z of the upper swing body 3 based on the reference position data item P and the swing body orientation data item Q acquired from the global coordinate calculation unit 23. In the swing center position data item XR, the reference position PL of the local coordinate system matches the xy coordinate.

The bucket blade tip position data item generation unit 28B generates the bucket blade tip position data item S indicating the current position of the blade tip 8T of the bucket 8 based on the swing center position data item XR and the inclination angles θ1, θ2, and θ3 of the working unit 2.

As described above, the bucket blade tip position data item generation unit 28B acquires the reference position data item P and the swing body orientation data item Q from the global coordinate calculation unit 23 at, for example, a frequency of 10 Hz. Accordingly, the bucket blade tip position data item generation unit 28B can update the bucket blade tip position data item S at, for example, a frequency of 10 Hz. The bucket blade tip position data item generation unit 28B outputs the updated bucket blade tip position data item S to the target excavation ground shape data item generation unit 28C.

The target excavation ground shape data item generation unit 28C acquires the target construction information item T stored in the target construction information item storage unit 28A and the bucket blade tip position data item S from the bucket blade tip position data item generation unit 28B. The target excavation ground shape data item generation unit 28C sets an intersection point between the perpendicular line passing through a blade tip position P4 at the current time point of the blade tip 8T and the target construction face 41 in the local coordinate system as an excavation target position 44. The excavation target position 44 is a point directly below the blade tip position P4 of the bucket 8. As illustrated in FIG. 4, the target excavation ground shape data item generation unit 28C acquires an intersection line 43 between a plane 42 of the working unit 2 defined in the front to back direction of the upper swing body 3 and passing through the excavation target position 44 and the target construction information item T represented by the plurality of target construction faces 41 as a candidate line of the target excavation ground shape 43I based on the target construction information item T and the bucket blade tip position data item S. The excavation target position 44 is one point on the candidate line. The plane 42 is a plane (an operation plane) where the working unit 2 is operated.

The operation plane of the working unit 2 is a plane that is parallel to an xz plane of the excavator 100 when the boom 6 and the arm 7 do not rotate about the axis parallel to the z axis of the local coordinate system of the excavator 100. When at least one of the boom 6 and the arm 7 rotates about the axis parallel to the z axis of the local coordinate system of the excavator 100, the operation plane of the working unit 2 is a plane perpendicular to the rotation axis of the arm, that is, a plane perpendicular to the axis of the arm pin 14 illustrated in FIG. 1. Hereinafter, the operation plane of the working unit 2 will be appropriately referred to as an arm operation plane.

The target excavation ground shape data item generation unit 28C determines one or more inflection points around the excavation target position 44 of the target construction information item T and the lines therearound as the target excavation ground shape 43I serving as the excavation target. In the example illustrated in FIG. 4, two inflection points Pv1 and Pv2 and the lines therearound are determined as the target excavation ground shape 43I. Then, the target excavation ground shape data item generation unit 28C generates a position information item of one or more inflection points around the excavation target position 44 and an angle information item of the lines therearound as the target excavation ground shape data item U as an information item indicating the target shape of the excavation target. In the present embodiment, the target excavation ground shape 43I is defined by lines, but may be defined as a plane based on, for example, the width of the bucket 8 or the like. The target excavation ground shape data item U which is generated in this way includes an information item of a part of the plurality of target construction faces 41. The target excavation ground shape data item generation unit 28C outputs the generated target excavation ground shape data item U to the working unit controller 26. In the present embodiment, the display controller 28 and the working unit controller directly exchange signals, but may exchange signals via, for example, an in-vehicle signal line such as CAN (Controller Area Network).

In the present embodiment, the target excavation ground shape data item U is an information item at the intersection portion between the plane 42 as the operation plane where the working unit 2 is operated and at least one target construction face (a first target construction face) 41 prepared in advance. The plane 42 is the xz plane in the local coordinate system (x, y, z) illustrated in FIGS. 3A and 3B. The target excavation ground shape data item U which is obtained by cutting out the plurality of target construction faces 41 in the plane 42 will be appropriately referred to as a front-to-back-direction target excavation ground shape data item U.

The display controller 28 causes the display unit 29 to display the target excavation ground shape 43I based on the target excavation ground shape data item U if necessary. As the display information item, the display target excavation ground shape data item Ua is used. The display unit 29 displays, for example, an image as illustrated in FIG. 5 indicating a positional relation between the target excavation ground shape 43I set as the excavation target of the bucket 8 and the blade tip 8T based on the display target excavation ground shape data item Ua. The display controller 28 causes the display unit 29 to display the target excavation ground shape (the display target excavation ground shape) 43I based on the display target excavation ground shape data item Ua. The target excavation ground shape data item U output to the working unit controller 26 is used in the excavation control. The target excavation ground shape data item U used in the excavation control will be appropriately referred to as a working target excavation ground shape data item.

As described above, the target excavation ground shape data item generation unit 28C acquires the bucket blade tip position data item S from the bucket blade tip position data item generation unit 28B at, for example, a frequency of 10 Hz. Accordingly, the target excavation ground shape data item generation unit 28C can update the target excavation ground shape data item U at, for example, a frequency of 10

Hz and output the target excavation ground shape data item to the working unit controller 26. The working unit controller 26 can acquire the target excavation ground shape data item U in a cycle in which the target excavation ground shape data item generation unit 28C generates the target excavation ground shape data item U.

The error determination unit 28D outputs an error signal J to the working unit controller 26 when, for example, the GNSS antennas 21 and 22 illustrated in FIGS. 1 and 2 cannot receive the reference position data items P1 and P2 from a positioning satellite and as a result the reference position data item P cannot be acquired from the global coordinate calculation unit 23. The error determination unit 28D may output the error signal J when, for example, the bucket blade tip position data item generation unit 28B cannot generate the bucket blade tip position data item S and as a result the target excavation ground shape data item generation unit 28C cannot generate the target excavation ground shape data item U. Furthermore, the error determination unit 28D may output the error signal J when the target excavation ground shape data item generation unit 28C cannot acquire the target construction information item T from the target construction information item storage unit 28A and as a result the target excavation ground shape data item U cannot be generated. That is, the error determination unit 28D can output the error signal J when, for example, the target excavation ground shape data item generation unit 28C cannot generate the target excavation ground shape data item U. The same applies to, for example, a case where the working unit 2, more specifically, the bucket 8 deviates from the target construction face 41 during the excavation control.

The excavation control is performed on the target construction face 41 that derives the target excavation ground shape 43I; however, a description will be given about a process in the case where the working unit 2, more specifically, the bucket 8 deviates from the target construction face 41 during the excavation control. The target construction face 41 is set for each construction site; however, since this setting is not always simple, there is a case where only a part of the target construction information item T necessary for the construction is created. When the blade tip 8T of the bucket 8 moves to a place where the target construction face 41 does not exist, the display controller 28 acquires the target excavation ground shape 43I as an invalid value and outputs the target excavation ground shape. The working unit controller 26 calculates the distance between the target excavation ground shape 43I as an invalid value in this case and the excavation target position 44 existing below the blade tip 8T of the bucket 8, as an infinite value.

When the target excavation ground shape 43I on which the excavation control is performed and the blade tip 8T of the bucket 8 are close to each other and the upward movement operation of the boom is performed by a control (hereinafter, appropriately referred to as a boom interposition control) in which the boom 6 is interposed (within the boom limitation distance) is performed, the distance between the target excavation ground shape 43I and the blade tip 8T of the bucket 8 increases, and hence the upward movement operation of the boom 6 is released. At this time, the working unit controller 26 slowly closes an electromagnetic valve 27E so that the upward movement operation of the boom 6 is gradually switched to the release of the upward movement operation of the boom 6. This process will be referred to as a modulation process.

When the distance between the target excavation ground shape 43I and the blade tip 8T of the bucket 8 abruptly increases, the boom 6 abruptly moves downward, and hence there is a possibility that the operator of the excavator be unexpectedly shocked. The modulation process can solve the shock. An exception of the condition in which the modulation process is performed includes a case in which the distance between the target excavation ground shape 43I and the blade tip 8T of the bucket 8 is within a predetermined distance (for example, 3000 mm) larger than the boom limitation distance (which is a first predetermined value dth1 to be described later and is, for example, 800 mm). When this condition is established, the working unit controller 26 does not perform the modulation process. For example, the boom interposition control is not performed as in the case where the operator moves the working unit 2 toward a ground shape below a ground shape having a large step and the excavation target position 44 does not exist on the target construction face 41. In this case, the excavation control is not performed based on the operator's intention. In this case, the generation of the shock is allowed according to the operator's intention.

The display controller 28 performs initialization work when the GNSS antennas 21 and 22 cannot receive the reference position data items P1 and P2 from a positioning satellite and as a result the target excavation ground shape data item generation unit 28C cannot generate the target excavation ground shape data item U. Next, the working unit controller 26 will be described.

The working unit controller 26 includes a target velocity determination unit 52, a distance acquisition unit 53, a limitation velocity determination unit 54, a working unit control unit 57, a data item storage unit 58, and a switching unit 59. The working unit controller 26 performs the excavation control by using the target excavation ground shape 43I based on the above-described front-to-back-direction target excavation ground shape data item U. In this way, in the present embodiment, there are the target excavation ground shape 43I used for display and the target excavation ground shape 43I used in the excavation control. The former will be referred to as a display target excavation ground shape, and the latter will be referred to as an excavation control target excavation ground shape.

In the present embodiment, functions of the target velocity determination unit 52, the distance acquisition unit 53, the limitation velocity determination unit 54, the working unit control unit 57, the data item storage unit 58, and the switching unit 59 are realized by the process unit 26P illustrated in FIG. 2. Next, the excavation control by the working unit controller 26 will be described. The excavation control is an example of the excavation control in the front to back direction of the working unit 2, but the excavation control is also possible in the width direction of the working unit 2.

The target velocity determination unit 52 determines a boom target velocity Vc_bm, an arm target velocity Vc_am, and a bucket target velocity Vc_bkt. The boom target velocity Vc_bm is a velocity of the blade tip 8T when only the boom cylinder 10 is driven. The arm target velocity Vc_am is a velocity of the blade tip 8T when only the arm cylinder 11 is driven. The bucket target velocity Vc_bkt is a velocity of the blade tip 8T when only the bucket cylinder 12 is driven. The boom target velocity Vc_bm is calculated in response to the boom operation amount MB. The arm target velocity Vc_am is calculated in response to the arm operation amount MA. The bucket target velocity Vc_bkt is calculated in response to the bucket operation amount MT.

The storage unit 26M stores a target velocity information item of defining a relation between the boom operation amount MB and the boom target velocity Vc_bm. The target velocity determination unit 52 determines the boom target velocity Vc_bm corresponding to the boom operation amount MB by referring to the target velocity information item. The target velocity information item is a graph in which, for example, a magnitude of the boom target velocity Vc_bm with respect to the boom operation amount MB is described. The target velocity information item may be in the form of a table or an equation. The target velocity information item includes an information item of defining a relation between the arm operation amount MA and the arm target velocity Vc_am. The target velocity information item includes an information item of defining a relation between the bucket operation amount MT and the bucket target velocity Vc_bkt. The target velocity determination unit 52 determines the arm target velocity Vc_am corresponding to the arm operation amount MA by referring to the target velocity information item. The target velocity determination unit 52 determines the bucket target velocity Vc_bkt corresponding to the bucket operation amount MT by referring to the target velocity information item. As illustrated in FIG. 7, the target velocity determination unit 52 converts the boom target velocity Vc_bm into a velocity element (hereinafter, appropriately referred to as a perpendicular velocity element) Vcy_bm in a direction perpendicular to the target excavation ground shape 43I (the target excavation ground shape data item U) and a velocity element (hereinafter, appropriately referred to as a horizontal velocity element) Vcx_bm in a direction parallel to the target excavation ground shape 43I (the target excavation ground shape data item U).

For example, the target velocity determination unit 52 first acquires the inclination angle θ5 from the sensor controller 39, and obtains an inclination in the direction perpendicular to the target excavation ground shape 43I with respect to the perpendicular axis of the global coordinate system. Then, the target velocity determination unit 52 obtains an angle β2 (see FIG. 8) representing an inclination between the perpendicular axis of the local coordinate system and the direction perpendicular to the target excavation ground shape 43I from such an inclination.

Next, as illustrated in FIG. 8, the target velocity determination unit 52 converts the boom target velocity Vc_bm into a velocity element VL1_bm in the perpendicular axis direction of the local coordinate system and a velocity element VL2_bm in the horizontal axis direction by a trigonometric function from the angle β2 formed between the perpendicular axis of the local coordinate system and the direction of the boom target velocity Vc_bm. Then, as illustrated in FIG. 9, the target velocity determination unit 52 converts the velocity element VL1_bm in the perpendicular axis direction of the local coordinate system and the velocity element VL2_bm in the horizontal axis direction into the perpendicular velocity element Vcy_bm and the horizontal velocity element Vcx_bm with respect to the above-described target excavation ground shape 43I by a trigonometric function from an inclination β1 formed between the perpendicular axis of the above-described local coordinate system and the direction perpendicular to the target excavation ground shape 43I. Similarly, the target velocity determination unit 52 converts the arm target velocity Vc_am into a perpendicular velocity element Vcy_am in the perpendicular axis direction of the local coordinate system and a horizontal velocity element Vcx_am. The target velocity determination unit 52 converts the bucket target velocity Vc_bkt into a perpendicular velocity element Vcy_bkt in the perpendicular axis direction of the local coordinate system and a horizontal velocity element Vcx_bkt.

As illustrated in FIG. 10, the distance acquisition unit 53 acquires a distance d between the blade tip 8T of the bucket 8 and the target excavation ground shape 43I. In particular, the distance acquisition unit 53 calculates the distance d serving as the shortest distance between the blade tip 8T of the bucket 8 and the target excavation ground shape 43I from the position information item of the blade tip 8T acquired as described above and the target excavation ground shape data item U indicating the position of the target excavation ground shape 43I. In the present embodiment, the excavation control is performed based on the distance d serving as the shortest distance between the blade tip 8T of the bucket 8 and the target excavation ground shape 43I.

The limitation velocity determination unit 54 calculates a limitation velocity Vcy_lmt of the entire working unit 2 illustrated in FIG. 1 based on the distance d between the blade tip 8T of the bucket 8 and the target excavation ground shape 43I. The limitation velocity Vcy_lmt of the entire working unit 2 is a movement velocity of the blade tip 8T allowable in a direction in which the blade tip 8T of the bucket 8 approaches the target excavation ground shape 43I. The storage unit 26M illustrated in FIG. 2 stores a limitation velocity information item of defining a relation between the distance d and the limitation velocity Vcy_lmt.

FIG. 11 illustrates an example of the limitation velocity information item. In FIG. 11, the horizontal axis is the distance d, and the vertical axis is the limitation velocity Vcy. In the present embodiment, the distance d when the blade tip 8T is located outside the target excavation ground shape 43I, that is, at the working unit 2 side of the excavator 100, is a positive value, and the distance d when the blade tip 8T is located inside the target excavation ground shape 43I, that is, inside the excavation target in relation to the target excavation ground shape 43I, is a negative value. For example, as illustrated in FIG. 10, it can also be said that the distance d when the blade tip 8T is located above the target excavation ground shape 43I is a positive value and the distance d when the blade tip 8T is located below the target excavation ground shape 43I is a negative value. Furthermore, it can also be said that the distance d when the blade tip 8T is at a position of not eroding the target excavation ground shape 43I is a positive value and the distance d when the blade tip 8T is at a position of eroding the target excavation ground shape 43I is a negative value. The distance d when the blade tip 8T is located on the target excavation ground shape 43I, that is, when the blade tip 8T is in contact with the target excavation ground shape 43I, is zero.

In the present embodiment, it is assumed that the velocity when the blade tip 8T proceeds from the inside of the target excavation ground shape 43I to the outside thereof is a positive value and the velocity when the blade tip 8T proceeds from the outside of the target excavation ground shape 43I to the inside thereof is a negative value. That is, it is assumed that the velocity when the blade tip 8T proceeds to the upside of the target excavation ground shape 43I is a positive value and the velocity when the blade tip 8T proceeds to the downside is a negative value.

In the limitation velocity information item, the inclination of the limitation velocity Vcy_lmt when the distance d is between d1 and d2 is smaller than the inclination when the distance d is equal to or more than d1 or equal to or less than d2. d1 is larger than zero. d2 is smaller than zero. In order to more particularly set the limitation velocity in the operation near the target excavation ground shape 43I, the inclination when the distance d is between d1 and d2 is set to be smaller than the inclination when the distance d is equal to or more than d1 or equal to or less than d2. When the distance d is equal to or more than d1, the limitation velocity Vcy_lmt is a negative value, and the limitation velocity Vcy_lmt decreases as the distance d increases. That is, when the distance d is equal to or more than d1, the velocity toward the downside of the target excavation ground shape 43I increases and the absolute value of the limitation velocity Vcy_lmt increases as the blade tip 8T above the target excavation ground shape 43I moves away from the target excavation ground shape 43I. When the distance d is equal to or less than zero, the limitation velocity Vcy_lmt is a positive value, and the limitation velocity Vcy_lmt increases as the distance d decreases. That is, when the distance d in which the blade tip 8T of the bucket 8 moves away from the target excavation ground shape 43I is equal to or less than zero, the velocity toward the upside of the target excavation ground shape 43I increases and the absolute value of the limitation velocity Vcy_lmt increases as the blade tip 8T below the target excavation ground shape 43I moves away from the target excavation ground shape 43I.

When the distance d is equal to or more than a first predetermined value dth1, the limitation velocity Vcy_lmt becomes Vmin. The first predetermined value dth1 is a positive value and is larger than d1. Vmin is smaller than the minimum value of the target velocity. That is, when the distance d is equal to or more than the first predetermined value dth1, the operation of the working unit 2 is not limited. Accordingly, when the blade tip 8T above the target excavation ground shape 43I largely moves away from the target excavation ground shape 43I, the limitation of the operation of the working unit 2, that is, the excavation control is not performed. When the distance d is smaller than the first predetermined value dth1, the operation of the working unit 2 is limited. In particular, as will be described later, the operation of the boom 6 is limited when the distance d is smaller than the first predetermined value dth1.

The limitation velocity determination unit 54 calculates the perpendicular velocity element (hereinafter, appropriately referred to as a limitation perpendicular velocity element of the boom 6) Vcy_bm_lmt of the limitation velocity of the boom 6 from the limitation velocity Vcy_lmt of the entire working unit 2, the arm target velocity Vc_am, and the bucket target velocity Vc_bkt. As illustrated in FIG. 12, the limitation velocity determination unit 54 calculates a limitation perpendicular velocity element Vcy_bm_lmt of the boom 6 by subtracting the perpendicular velocity element Vcy_am of the arm target velocity and the perpendicular velocity element Vcy_bkt of the bucket target velocity from the limitation velocity Vcy_lmt of the entire working unit 2.

As illustrated in FIG. 13, the limitation velocity determination unit 54 converts the limitation perpendicular velocity element Vcy_bm_lmt of the boom 6 into a limitation velocity (a boom limitation velocity) Vc_bm_lmt of the boom 6. The limitation velocity determination unit 54 obtains a relation between the direction perpendicular to the target excavation ground shape 43I and the direction of the boom limitation velocity Vc_bm_lmt from the inclination angle θ1 of the boom 6, the inclination angle θ2 of the arm 7, the inclination angle θ3 of the bucket 8, the reference position data item of the GNSS antennas 21 and 22, the target excavation ground shape data item U and the like as described above, and converts the limitation perpendicular velocity element Vcy_bm_lmt of the boom 6 into the boom limitation velocity Vc_bm_lmt. The calculation in this case is performed according to an opposite procedure to the calculation of obtaining the perpendicular velocity element Vcy_bm in the direction perpendicular to the target excavation ground shape 43I from the boom target velocity Vc_bm as described above.

The shuttle valve 51 illustrated in FIG. 2 selects a larger one from among the pilot pressure generated based on the operation of the boom 6 and the pilot pressure generated by the interposition valve 27C based on the boom interposition instruction CBI, and supplies the pilot pressure to the direction control valve 64. When the pilot pressure based on the boom interposition instruction CBI is larger than the pilot pressure generated based on the operation of the boom 6, the direction control valve 64 corresponding to the boom cylinder 10 is operated by the pilot pressure based on the boom interposition instruction CBI. As a result, drive of the boom 6 based on the boom limitation velocity Vc_bm_lmt is realized.

The working unit control unit 57 controls the working unit 2. The working unit control unit 57 controls the boom cylinder 10, the arm cylinder 11, and the bucket cylinder 12 by outputting the arm instruction signal, the boom instruction signal, the boom interposition instruction CBI, and the bucket instruction signal to the control valve 27 and the interposition valve 27C illustrated in FIG. 2. The arm instruction signal, the boom instruction signal, the boom interposition instruction CBI, and the bucket instruction signal respectively include current values responding to the boom instruction velocity, the arm instruction velocity, and the bucket instruction velocity.

When the pilot pressure generated based on the upward movement operation of the boom 6 is larger than the pilot pressure based on the boom interposition instruction CBI, the shuttle valve 51 selects the pilot pressure based on the lever operation. The direction control valve 64 corresponding to the boom cylinder 10 is operated by the pilot pressure selected by the shuttle valve 51 based on the operation of the boom 6. That is, since the boom 6 is driven based on the boom target velocity Vc_bm, the boom is not driven based on the boom limitation velocity Vc_bm_lmt.

When the pilot pressure generated based on the operation of the boom 6 is larger than the pilot pressure based on the boom interposition instruction CBI, the working unit control unit 57 respectively selects the boom target velocity Vc_bm, the arm target velocity Vc_am, and the bucket target velocity Vc_bkt as the boom instruction velocity, the arm instruction velocity, and the bucket instruction velocity. The working unit control unit 57 determines the velocities (a cylinder velocity) of the boom cylinder 10, the arm cylinder 11, and the bucket cylinder 12 in response to the boom target velocity Vc_bm, the arm target velocity Vc_am, and the bucket target velocity Vc_bkt. Then, the working unit control unit 57 operates the boom cylinder 10, the arm cylinder 11, and the bucket cylinder 12 by controlling the control valve 27 based on the determined cylinder velocity.

In this way, in the normal operation, the working unit control unit 57 operates the boom cylinder 10, the arm cylinder 11, and the bucket cylinder 12 in response to the boom operation amount MB, the arm operation amount MA, and the bucket operation amount MT. Accordingly, the boom cylinder 10 is operated at the boom target velocity Vc_bm, the arm cylinder 11 is operated at the arm target velocity Vc_am, and the bucket cylinder 12 is operated at the bucket target velocity Vc_bkt.

When the pilot pressure based on the boom interposition instruction CBI is larger than the pilot pressure generated based on the operation of the boom 6, the shuttle valve 51 selects the pilot pressure output from the interposition valve 27C based on the interposition instruction. As a result, the boom 6 is operated at the boom limitation velocity Vc_bm_lmt, while the arm 7 is operated at the arm target velocity Vc_am. Furthermore, the bucket 8 is operated at the bucket target velocity Vc_bkt.

As described above, the limitation perpendicular velocity element Vcy_bm_lmt of the boom 6 is calculated by subtracting the perpendicular velocity element Vcy_am of the arm target velocity and the perpendicular velocity element Vcy_bkt of the bucket target velocity from the limitation velocity Vcy_lmt of the entire working unit 2. Accordingly, when the limitation velocity Vcy_lmt of the entire working unit 2 is smaller than the sum of the perpendicular velocity element Vcy_am of the arm target velocity and the perpendicular velocity element Vcy_bkt of the bucket target velocity, the limitation perpendicular velocity element Vcy_bm_lmt of the boom 6 becomes a negative value at which the boom moves upward.

Accordingly, the boom limitation velocity Vc_bm_lmt becomes a negative value. In this case, the working unit control unit 57 moves the boom 6 downward, but decreases the speed thereof to be smaller than the boom target velocity Vc_bm. For this reason, it is possible to restrain the bucket 8 from eroding the target excavation ground shape 43I while keeping the operator's uncomfortable feeling small.

When the limitation velocity Vcy_lmt of the entire working unit 2 is larger than the sum of the perpendicular velocity element Vcy_am of the arm target velocity and the perpendicular velocity element Vcy_bkt of the bucket target velocity, the limitation perpendicular velocity element Vcy_bm_lmt of the boom 6 becomes a positive value. Accordingly, the boom limitation velocity Vc_bm_lmt becomes a positive value. In this case, even when the operation device 25 is operated in a direction in which the boom 6 moves downward, the boom 6 moves upward based on the instruction signal from the interposition valve 27C illustrated in FIG. 2. For this reason, it is possible to promptly restrain the expansion of the erosion of the target excavation ground shape 43I.

When the blade tip 8T is located above the target excavation ground shape 43I, the absolute value of the limitation perpendicular velocity element Vcy_bm_lmt of the boom 6 decreases and the absolute value of the velocity element (hereinafter, appropriately referred to as a limitation horizontal velocity element) Vcx_bm_lmt of the limitation velocity of the boom 6 in a direction parallel to the target excavation ground shape 43I also decreases as the blade tip 8T approaches the target excavation ground shape 43I. Accordingly, when the blade tip 8T is located above the target excavation ground shape 43I, the velocity in the direction perpendicular to the target excavation ground shape 43I of the boom 6 and the velocity in a direction parallel to the target excavation ground shape 43I of the boom 6 decrease together as the blade tip 8T approaches the target excavation ground shape 43I. The arm 7, and the bucket 8 are operated at the same time in a manner such that the left operation lever 25L and the right operation lever 25R are operated at the same time by the operator of the excavator, the boom 6. At this time, assuming that the target velocity Vc_bm, Vc_am, Vc_bkt of the boom 6, the arm 7, and the bucket 8 are input, the above-described control is as described below.

FIG. 14 illustrates an example of a change in the limitation velocity of the boom 6 when the distance d between the target excavation ground shape 43I and the blade tip 8T of the bucket 8 is smaller than the first predetermined value dth1 and the blade tip of the bucket 8 moves from a position Pn1 to a position Pn2. The distance between the blade tip 8T at the position Pn2 and the target excavation ground shape 43I is smaller than the distance between the blade tip 8T at the position Pn1 and the target excavation ground shape 43I. For this reason, a limitation perpendicular velocity element Vcy_bm_lmt2 of the boom 6 at the position Pn2 is smaller than a limitation perpendicular velocity element Vcy_bm_lmt1 of the boom 6 at the position Pn1. Accordingly, a boom limitation velocity Vc_bm_lmt2 at the position Pn2 is smaller than a boom limitation velocity Vc_bm_lmt1 at the position Pn1. Furthermore, a limitation horizontal velocity element Vcx_bm_lmt2 of the boom 6 at the position Pn2 is smaller than a limitation horizontal velocity element Vcx_bm_lmt1 of the boom 6 at the position Pn1. However, at this time, the arm target velocity Vc_am and the bucket target velocity Vc_bkt are not limited. For this reason, the perpendicular velocity element Vcy_am and the horizontal velocity element Vcx_am of the arm target velocity and the perpendicular velocity element Vcy_bkt and the horizontal velocity element Vcx_bkt of the bucket target velocity are not limited.

As described above, a change in the arm operation amount corresponding to the operator's excavation intention is reflected as a change in the velocity of the blade tip 8T of the bucket 8 in a manner such that the arm 7 is not limited. For this reason, the present embodiment can restrain the uncomfortable feeling during the excavation operation of the operator while restraining the expansion of the erosion of the target excavation ground shape 43I.

The data item storage unit 58 illustrated in FIG. 5 acquires the design ground shape data item U output from the design ground shape data item generation unit 28C of the display controller 28 in, for example, a cycle of 100 msec and stores the design data item U obtained one cycle before. The data item storage unit 58 stores, for example, the design ground shape data item U obtained one cycle before and the current design ground shape data item U, and sequentially deletes the oldest design ground shape data item U at a time point at which the next new design ground shape data item U is acquired. In this way, the storage of the design ground shape data item U ends after a certain time elapses. Furthermore, when the excavator 100 travels or the working unit 2 swings, the data item storage unit 58 deletes the stored design ground shape data item U and ends the storage of the design ground shape data item U. The data item storage unit 58 determines whether the excavator 100 travels or the working unit 2 swings based on, for example, the swing operation amount MR of the left operation lever 25L or the operation amount MD of the traveling levers 25FL and 25FR illustrated in FIG. 2.

The switching unit 59 outputs any one of the design ground shape data item U of the design ground shape data item generation unit 28C and the design ground shape data item U stored in the data item storage unit 58 to the distance acquisition unit 53 in response to the error signal J output from the error determination unit 28D of the display controller 28. In the embodiment, the switching unit 59 outputs the design ground shape data item U stored in the data item storage unit 58 to the distance acquisition unit 53 when the error signal J is acquired from the error determination unit 28D, and outputs the design ground shape data item U output from the design ground shape data item generation unit 28C to the distance acquisition unit 53 when the error signal J is not acquired from the error determination unit 28D.

The above-described working unit control unit 57 ends an area limitation excavation control when the excavator 100 travels or the working unit 2 swings. In this case, the working unit control unit 57 determines whether the excavator 100 travels or the working unit 2 swings based on, for example, the swing operation amount MR of the left operation lever 25L or the operation amount MD of the traveling levers 25FL and 25FR illustrated in FIG. 2.

The blade tip position P4 of the blade tip 8T may be measured by other positioning device instead of the GNSS. Accordingly, the distance d between the blade tip 8T and the target excavation ground shape 43I may be measured by other positioning device instead of the GNSS. The absolute value of the bucket limitation velocity is smaller than the absolute value of the bucket target velocity. The bucket limitation velocity may be calculated by, for example, the same method as the arm limitation velocity. Note that the arm 7 and the bucket 8 may be limited together. Next, the details of the hydraulic system 300 illustrated in FIG. 2 and the operation of the hydraulic system 300 during the excavation control will be described.

Figure 15:
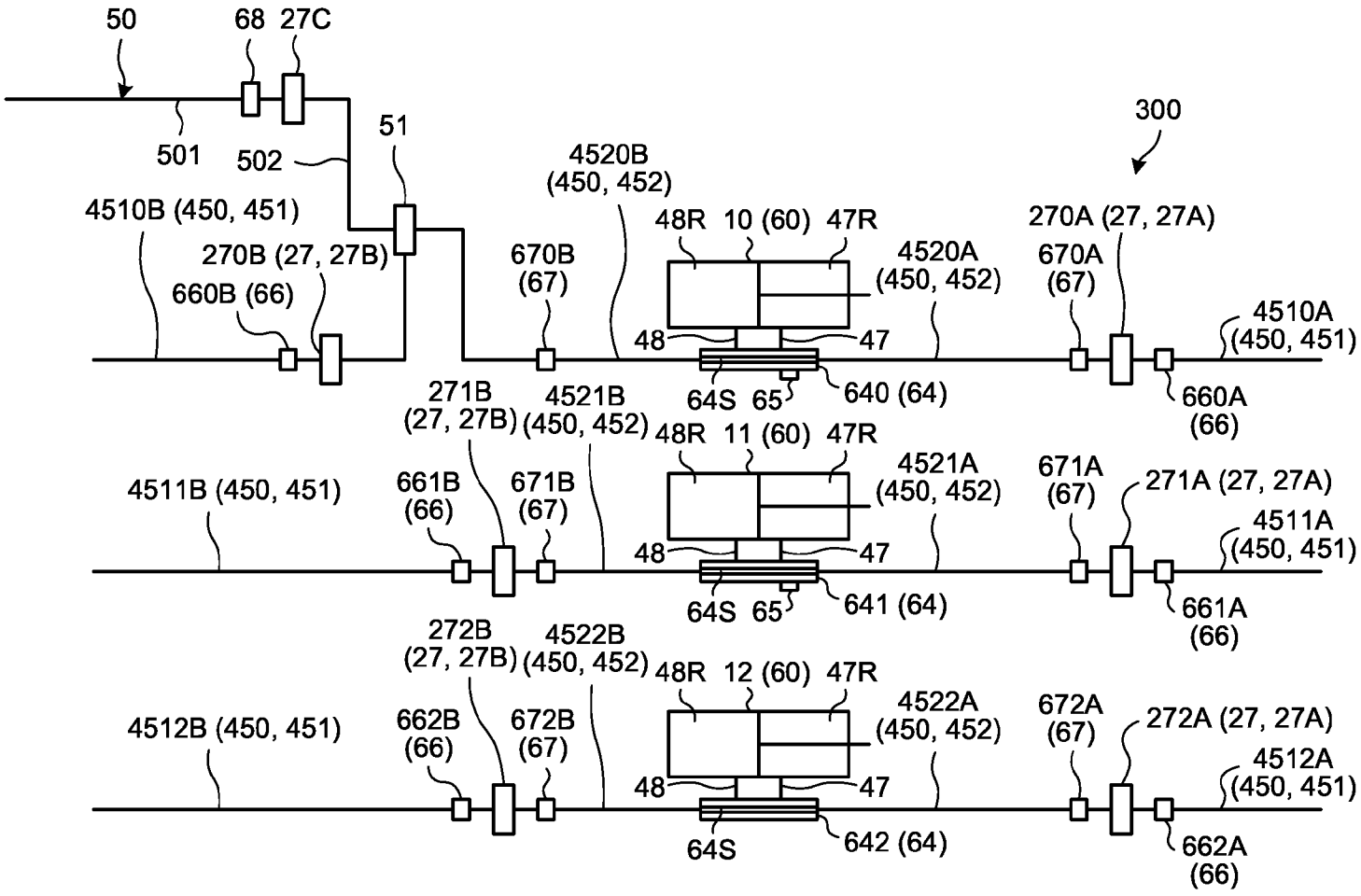
FIG. 15 is a diagram illustrating a detailed structure of a hydraulic system 300 that is included in an excavator 100.

FIG. 15 is a diagram illustrating a detailed structure of the hydraulic system 300 that is included in the excavator 100. As illustrated in FIG. 15, the hydraulic system 300 includes a hydraulic cylinder 60 with the boom cylinder 10, the arm cylinder 11, and the bucket cylinder 12. The hydraulic cylinder 60 is operated by the working oil supplied from the hydraulic pumps 36 and 37 illustrated in FIG. 2.

In the present embodiment, the direction control valve 64 that controls the direction in which the working oil flows is provided. The direction control valve 64 is disposed in each of the boom cylinder 10, the arm cylinder 11, and the bucket cylinder 12. Hereinafter, the boom cylinder 10, the arm cylinder 11, and the bucket cylinder 12 will be referred to as the hydraulic cylinder 60 when the cylinders are not distinguished from one another. The direction control valve 64 is a spool type which moves a spool 64S in a rod shape and changes the direction in which the working oil flows. The spool 64S moves by the pilot oil of the working oil supplied from the operation device 25 illustrated in FIG. 2. The direction control valve 64 supplies the working oil (hereinafter, appropriately referred to as the pilot oil) to the hydraulic cylinder 60 by the movement of the spool and operates the hydraulic cylinder 60.

The working oil supplied from the hydraulic pumps 36 and 37 illustrated in FIG. 2 is supplied to the hydraulic cylinder 60 through the direction control valve 64. The spool 64S moves in the axis direction, and thus the supply of the working oil to a cap side oil chamber 48R of the hydraulic cylinder 60 and the supply of the working oil to a rod side oil chamber 47R are switched. Furthermore, the spool 64S moves in the axis direction, and thus a supply amount (a supply amount per unit time) of the working oil to the hydraulic cylinder 60 is adjusted. The supply amount of the working oil to the hydraulic cylinder 60 is adjusted, and thus the cylinder velocity of the hydraulic cylinder 60 is adjusted. A spool stroke sensor 65 which detects a movement amount (a movement distance) of the spool 64S is provided in a direction control valve 640 to be described later which supplies the working oil to the boom cylinder 10 and a direction control valve 641 to be described later which supplies the working oil to the arm cylinder 11.

The operation of the direction control valve 64 is adjusted by the operation device 25. The working oil which is supplied from the hydraulic pump 36 and is depressurized by the depressurization valve is supplied as the pilot oil to the operation device 25. The pilot oil which is supplied from a pilot hydraulic pump different from the hydraulic pump 36 may be supplied to the operation device 25. The operation device 25 is adjusted to a pilot hydraulic pressure based on the operation of each operation lever. The direction control valve 64 is driven by the pilot hydraulic pressure. Since the pilot hydraulic pressure is adjusted by the operation device 25, the movement amount of the spool 64S with respect to the axis direction is adjusted.

The direction control valve 64 is provided in each of the boom cylinder 10, the arm cylinder 11, and the bucket cylinder 12. In the description below, the direction control valve 64 which is connected to the boom cylinder 10 will be appropriately referred to as the direction control valve 640. The direction control valve 64 which is connected to the arm cylinder 11 will be appropriately referred to as the direction control valve 641. The direction control valve 64 which is connected to the bucket cylinder 12 will be appropriately referred to as the direction control valve 642.

The operation device 25 and the direction control valve 64 are connected to each other through the pilot passageway 450. The pilot oil used for moving the spool 64S of the direction control valve 64 flows through the pilot passageway 450. In the present embodiment, the control valve 27, the pressure sensor 66, and a pressure sensor 67 are disposed in the pilot passageway 450.

The pilot passageway 450 is connected to the direction control valve 64. The pilot oil is supplied to the direction control valve 64 through the pilot passageway 450. The direction control valve 64 includes a first pressure receiving chamber and a second pressure receiving chamber. The pilot passageway 450 is connected to the first pressure receiving chamber and the second pressure receiving chamber. When the pilot oil is supplied to the first pressure receiving chamber of the direction control valve 64 through pilot passageways 4520B, 4521B, and 4522B to be described later, the spool 64S moves in response to the pilot hydraulic pressure, and the working oil is supplied to the cap side oil chamber 48R of the hydraulic cylinder 60 through the direction control valve 64. The supply amount of the working oil to the cap side oil chamber 48R is adjusted by the operation amount of the operation device 25 (the movement amount of the spool 64S).

When the pilot oil is supplied to the second pressure receiving chamber of the direction control valve 64 through pilot passageways 4520A, 4521A, and 4522A to be described later, the spool moves in response to the pilot hydraulic pressure, and the working oil is supplied to the rod side oil chamber 47R of the hydraulic cylinder 60 through the direction control valve 64. The supply amount of the working oil to the rod side oil chamber 47R is adjusted by the operation amount of the operation device 25 (the movement amount of the spool 64S).

That is, the spool 64S moves toward one side in the axis direction, and thus the pilot oil having the pilot hydraulic pressure adjusted by the operation device 25 is supplied to the direction control valve 64. The spool 64S moves toward the other side in the axis direction, and thus the pilot oil having the pilot hydraulic pressure adjusted by the operation device 25 is supplied to the direction control valve 64. As a result, the position of the spool 64S with respect to the axis direction is adjusted.

In the description below, the pilot passageway 450 which is connected to the direction control valve 640 supplying the working oil to the boom cylinder 10 will be appropriately referred to as boom adjustment passageways 4520A and 4520B. The pilot passageway 450 which is connected to the direction control valve 641 supplying the working oil to the arm cylinder 11 will be appropriately referred to as arm adjustment passageways 4521A and 4521B. The pilot passageway 450 which is connected to the direction control valve 642 supplying the working oil to the bucket cylinder 12 will be appropriately referred to as bucket adjustment passageways 4522A and 4522B.

In the description below, the pilot passageway 450 connected to the boom adjustment passageway 4520A will be appropriately referred to as a boom operation passageway 4510A, and the pilot passageway 450 connected to the boom adjustment passageway 4520B will be appropriately referred to as a boom operation passageway 4510B. The pilot passageway 450 connected to the arm adjustment passageway 4521A will be appropriately referred to as an arm operation passageway 4511A, and the pilot passageway 450 connected to the arm adjustment passageway 4521B will be appropriately referred to as an arm operation passageway 4511B. The pilot passageway 450 connected to the bucket adjustment passageway 4522A will be appropriately referred to as a bucket operation passageway 4512A, and the pilot passageway 450 connected to the bucket adjustment passageway 4522B will be appropriately referred to as a bucket operation passageway 4512B.

The boom operation passageway (4510A, 4510B) and the boom adjustment passageway (4520A, 4520B) are connected to the pilot hydraulic type operation device 25. The pilot oil having the pressure adjusted in response to the operation amount of the operation device 25 flows to the boom operation passageway (4510A, 4510B). The arm operation passageway (4511A, 4511B) and the arm adjustment passageway (4521A, 4521B) are connected to the pilot hydraulic type operation device 25. The pilot oil having the pressure adjusted in response to the operation amount of the operation device 25 flows to the arm operation passageway (4511A, 4511B). The bucket operation passageway (4512A, 4512B) and the bucket adjustment passageway (4522A, 4522B) are connected to the pilot hydraulic type operation device 25. The pilot oil having the pressure adjusted in response to the operation amount of the operation device 25 flows to the bucket operation passageway (4512A, 4512B).

The boom operation passageway 4510A, the boom operation passageway 4510B, the boom adjustment passageway 4520A, and the boom adjustment passageway 4520B are boom passageways through which the pilot oil used for operating the boom 6 flows. The arm operation passageway 4511A, the arm operation passageway 4511B, the arm adjustment passageway 4521A, and the arm adjustment passageway 4521B are arm passageways through which the pilot oil used for operating the arm 7 flows. The bucket operation passageway 4512A, the bucket operation passageway 4512B, the bucket adjustment passageway 4522A, and the bucket adjustment passageway 4522B are bucket passageways through which the pilot oil used for operating the bucket 8 flows.

As described above, the boom 6 performs two kinds of operation of downward movement operation and upward movement operation by the operation of the operation device 25. The operation device 25 is operated so that the downward movement operation of the boom 6 is performed, and thus the pilot oil is supplied to the direction control valve 640 connected to the boom cylinder 10 through the boom operation passageway 4510A and the boom adjustment passageway 4520A. The direction control valve 640 is operated based on the pilot hydraulic pressure. As a result, the working oil is supplied from the hydraulic pumps 36 and 37 to the boom cylinder 10, and the downward movement operation of the boom 6 is performed.

The operation device 25 is operated so that the upward movement operation of the boom 6 is performed, and thus the pilot oil is supplied to the direction control valve 640 connected to the boom cylinder 10 through the boom operation passageway 4510B and the boom adjustment passageway 4520B. The direction control valve 640 is operated based on the pilot hydraulic pressure. As a result, the working oil is supplied from the hydraulic pumps 36 and 37 to the boom cylinder 10, and the upward movement operation of the boom 6 is performed.

That is, in the present embodiment, the boom operation passageway 4510A and the boom adjustment passageway 4520A are downward boom moving passageways which are connected to the second pressure receiving chamber of the direction control valve 640 and through which the pilot oil used for moving the boom 6 downward flows. The boom operation passageway 4510B and the boom adjustment passageway 4520B are upward boom moving passageways which are connected to the first pressure receiving chamber of the direction control valve 640 and through which the pilot oil used for moving the boom 6 upward flows.

Furthermore, the arm 7 performs two kinds of operation of downward movement operation and upward movement operation by the operation of the operation device 25. The operation device 25 is operated so that the upward movement operation of the arm 7 is performed, and thus the pilot oil is supplied to the direction control valve 641 connected to the arm cylinder 11 through the arm operation passageway 4511A and the arm adjustment passageway 4521A. The direction control valve 641 is operated based on the pilot hydraulic pressure. As a result, the working oil is supplied from the hydraulic pumps 36 and 37 to the arm cylinder 11, and the upward movement operation of the arm 7 is performed.

The operation device 25 is operated so that the downward movement operation of the arm 7 is performed, and thus the pilot oil is supplied to the direction control valve 641 connected to the arm cylinder 11 through the arm operation passageway 4511B and the arm adjustment passageway 4521B. The direction control valve 641 is operated based on the pilot hydraulic pressure. As a result, the working oil is supplied from the hydraulic pumps 36 and 37 to the arm cylinder 11, and the downward movement operation of the arm 7 is performed.

That is, in the present embodiment, the arm operation passageway 4511A and the arm adjustment passageway 4521A are upward arm moving passageways which are connected to the second pressure receiving chamber of the direction control valve 641 and through which the pilot oil used for moving the arm 7 upward flows. The arm operation passageway 4511B and the arm adjustment passageway 4521B are downward arm moving passageways which are connected to the first pressure receiving chamber of the direction control valve 641 and through which the pilot oil used for moving the arm 7 downward flows.

The bucket 8 performs two kinds of operation of downward movement operation and upward movement operation by the operation of the operation device 25. The operation device 25 is operated so that the upward movement operation of the bucket 8 is performed, and thus the pilot oil is supplied to the direction control valve 642 connected to the bucket cylinder 12 through the bucket operation passageway 4512A and the bucket adjustment passageway 4522A. The direction control valve 642 is operated based on the pilot hydraulic pressure. As a result, the working oil is supplied from the hydraulic pumps 36 and 37 to the bucket cylinder 12, and the upward movement operation of the bucket 8 is performed.

The operation device 25 is operated so that the downward movement operation of the bucket 8 is performed, and thus the pilot oil is supplied to the direction control valve 642 connected to the bucket cylinder 12 through the bucket operation passageway 4512B and the bucket adjustment passageway 4522B. The direction control valve 642 is operated based on the pilot hydraulic pressure. As a result, the working oil is supplied from the hydraulic pumps 36 and 37 to the bucket cylinder 12, and the downward movement operation of the bucket 8 is performed.

That is, in the present embodiment, the bucket operation passageway 4512A and the bucket adjustment passageway 4522A are upward bucket moving passageways which are connected to the second pressure receiving chamber of the direction control valve 642 and through which the pilot oil used for moving the bucket 8 upward flows. The bucket operation passageway 4512B and the bucket adjustment passageway 4522B are downward bucket moving passageways which are connected to the first pressure receiving chamber of the direction control valve 642 and through which the pilot oil used for moving the bucket 8 downward flows.

The control valve 27 adjusts the pilot hydraulic pressure, based on the control signal (current) from the working unit controller 26. The control valve 27 is, for example, an electromagnetic proportional control valve and is controlled based on the control signal from the working unit controller 26. The control valve 27 includes a control valve 27A and a control valve 27B. The control valve 27B adjusts the pilot hydraulic pressure of the pilot oil to be supplied to the first pressure receiving chamber of the direction control valve 64, and adjusts the amount of the working oil to be supplied through the direction control valve 64 to the cap side oil chamber 48R of the hydraulic cylinder 60. The control valve 27A adjusts the pilot hydraulic pressure of the pilot oil to be supplied to the second pressure receiving chamber of the direction control valve 64, and adjusts the amount of the working oil to be supplied through the direction control valve 64 to the rod side oil chamber 47R of the hydraulic cylinder 60.

The pressure sensor 66 and the pressure sensor 67 which detect the pilot hydraulic pressure are provided at both sides of the control valve 27. In the present embodiment, the pressure sensor 66 is disposed between the operation device 25 and the control valve 27 in a pilot passageway 451. The pressure sensor 67 is disposed between the control valve 27 and the direction control valve 64 in a pilot passageway 452. The pressure sensor 66 is capable of detecting the pilot hydraulic pressure that is not adjusted by the control valve 27. The pressure sensor 67 is capable of detecting the pilot hydraulic pressure adjusted by the control valve 27. The pressure sensor 66 is capable of detecting the pilot hydraulic pressure to be adjusted by the operation of the operation device 25. The detection results of the pressure sensor 66 and the pressure sensor 67 are output to the working unit controller 26.

In the description below, the control valve 27 which is capable of adjusting the pilot hydraulic pressure for the direction control valve 640 supplying the working oil to the boom cylinder 10 will be appropriately referred to as boom depressurization valves 270A and 270B. The boom depressurization valves 270A and 270B are disposed in the boom operation passageway. In the description below, the control valve 27 which is capable of adjusting the pilot hydraulic pressure for the direction control valve 641 supplying the working oil to the arm cylinder 11 will be appropriately referred to as arm depressurization valves 271A and 271B. The arm depressurization valves 271A and 271B are disposed in the arm operation passageway. In the description below, the control valve 27 which is capable of adjusting the pilot hydraulic pressure for the direction control valve 642 supplying the working oil to the bucket cylinder 12 will be appropriately referred to as a bucket depressurization valve 272. Bucket depressurization valves 272A and 272B are disposed in the bucket operation passageway.

In the description below, the pressure sensor 66 which detects the pilot hydraulic pressure of the pilot passageway 451 connected to the direction control valve 640 supplying the working oil to the boom cylinder 10 will be appropriately referred to as a boom pressure sensor 660B, and the pressure sensor 67 which detects the pilot hydraulic pressure of the pilot passageway 452 connected to the direction control valve 640 will be appropriately referred to as a boom pressure sensor 670A.

Furthermore, in the description below, a boom pressure sensor 660 which is disposed in the boom operation passageway 4510A will be appropriately referred to as a boom pressure sensor 660A, and the boom pressure sensor 660 which is disposed in the boom operation passageway 4510B will be appropriately referred to as the boom pressure sensor 660B. Furthermore, a boom pressure sensor 670 which is disposed in the boom adjustment passageway 4520A will be appropriately referred to as the boom pressure sensor 670A, and the boom pressure sensor 670 which is disposed in the boom adjustment passageway 4520B will be appropriately referred to as a boom pressure sensor 670B.

In the description below, the pressure sensor 66 which detects the pilot hydraulic pressure of the pilot passageway 451 connected to the direction control valve 641 supplying the working oil to the arm cylinder 11 will be appropriately referred to as an arm pressure sensor 661, and the pressure sensor 67 which detects the pilot hydraulic pressure of the pilot passageway 452 connected to the direction control valve 641 will be appropriately referred to as an arm pressure sensor 671.

Furthermore, in the description below, the arm pressure sensor 661 which is disposed in the arm operation passageway 4511A will be appropriately referred to as an arm pressure sensor 661A, and the arm pressure sensor 661 which is disposed in the arm operation passageway 4511B will be appropriately referred to as an arm pressure sensor 661B. Furthermore, the arm pressure sensor 671 which is disposed in the arm adjustment passageway 4521A will be appropriately referred to as an arm pressure sensor 671A, and the arm pressure sensor 671 which is disposed in the arm adjustment passageway 4521B will be appropriately referred to as an arm pressure sensor 671B.

In the description below, the pressure sensor 66 which detects the pilot hydraulic pressure of the pilot passageway 451 connected to the direction control valve 642 supplying the working oil to the bucket cylinder 12 will be appropriately referred to as a bucket pressure sensor 662, and the pressure sensor 67 which detects the pilot hydraulic pressure of the pilot passageway 452 connected to the direction control valve 642 will be appropriately referred to as a bucket pressure sensor 672.

Furthermore, in the description below, the bucket pressure sensor 661 which is disposed in the bucket operation passageway 4512A will be appropriately referred to as a bucket pressure sensor 661A, and the bucket pressure sensor 661 which is disposed in the bucket operation passageway 4512B will be appropriately referred to as a bucket pressure sensor 661B. Furthermore, the bucket pressure sensor 672 which is disposed in the bucket adjustment passageway 4522A will be appropriately referred to as a bucket pressure sensor 672A, and the bucket pressure sensor 672 which is disposed in the bucket adjustment passageway 4522B will be appropriately referred to as a bucket pressure sensor 672B.

When the excavation control is not performed, the working unit controller 26 controls the control valve 27 and opens the pilot passageway 450 (fully opened). The pilot passageway 450 opens, and thus the pilot hydraulic pressure of the pilot passageway 451 and the pilot hydraulic pressure of the pilot passageway 452 become equal to each other. In the state where the pilot passageway 450 is opened by the control valve 27, the pilot hydraulic pressure is adjusted based on the operation amount of the operation device 25.

When the pilot passageway 450 is fully opened by the control valve 27, the pilot hydraulic pressure acting on the pressure sensor 66 and the pilot hydraulic pressure acting on the pressure sensor 67 are equal to each other. The pilot hydraulic pressure acting on the pressure sensor 66 and the pilot hydraulic pressure acting on the pressure sensor 67 are different from each other in a manner such that the opening degree of the control valve 27 decreases.

When the working unit 2 is controlled by the working unit controller 26 as in the excavation control or the like, the working unit controller 26 outputs the control signal to the control valve 27. The pilot passageway 451 has a predetermined pressure (a pilot hydraulic pressure) by, for example, an action of a pilot relief valve. When the control signal is output from the working unit controller 26 to the control valve 27, the control valve 27 is operated based on the control signal. The pilot oil of the pilot passageway 451 is supplied to the pilot passageway 452 through the control valve 27. The pilot hydraulic pressure of the pilot passageway 452 is adjusted (depressurized) by the control valve 27. The pilot hydraulic pressure of the pilot passageway 452 acts on the direction control valve 64. Thus, the direction control valve 64 is operated based on the pilot hydraulic pressure controlled by the control valve 27. In the present embodiment, the pressure sensor 66 detects the pilot hydraulic pressure that is not adjusted by the control valve 27. The pressure sensor 67 detects the pilot hydraulic pressure adjusted by the control valve 27.

The pilot oil having the pressure adjusted by the depressurization valve 27A is supplied to the direction control valve 64, and thus the spool 64S moves toward one side in the axis direction. The pilot oil having the pressure adjusted by the depressurization valve 27B is supplied to the direction control valve 64, and thus the spool 64S moves toward the other side in the axis direction. As a result, the position of the spool 64S with respect to the axis direction is adjusted.

For example, the working unit controller 26 can output the control signal to at least one of the boom depressurization valve 270A and the boom depressurization valve 270B, and adjust the pilot hydraulic pressure for the direction control valve 640 connected to the boom cylinder 10.

Furthermore, the working unit controller 26 can output the control signal to at least one of the arm depressurization valve 271A and the arm depressurization valve 271B, and adjust the pilot hydraulic pressure for the direction control valve 641 connected to the arm cylinder 11.

Furthermore, the working unit controller 26 can output the control signal to at least one of the bucket depressurization valve 272A and the bucket depressurization valve 272B, and adjust the pilot hydraulic pressure for the direction control valve 642 connected to the bucket cylinder 12.

As described above, in the excavation control, the working unit controller 26 limits the velocity of the boom 6 so as to decrease the velocity at which the bucket 8 approaches the target excavation ground shape 43I in response to the distance d between the target excavation ground shape 43I and the bucket 8 based on the target excavation ground shape 43I (the target excavation ground shape data item U) indicating a design ground shape as the target shape of the excavation target and the bucket blade tip position data item S indicating the position of the bucket 8.

In the present embodiment, the working unit controller 26 includes a boom limitation unit which outputs a control signal used for limiting the velocity of the boom 6. In the present embodiment, in the case where the working unit 2 is driven based on the operation of the operation device 25, the movement of the boom 6 is controlled (the boom interposition control) based on the control signal output from the boom limitation unit of the working unit controller 26 so that the blade tip 8T of the bucket 8 does not enter the target excavation ground shape 43I. Specifically, in the excavation control, the upward movement operation of the boom 6 is performed by the working unit controller 26 so that the blade tip 8T does not enter the target excavation ground shape 43I.

In the present embodiment, in order to realize the boom interposition control, the interposition valve 27C which is operated based on the control signal related to the boom interposition control and output from the working unit controller 26 is provided in the pilot passageway 50. In the boom interposition control, the pilot oil having the pressure adjusted to the pilot hydraulic pressure flows through the pilot passageway 50. The interposition valve 27C is disposed in the pilot passageway 50 and is capable of adjusting the pilot hydraulic pressure of the pilot passageway 50.

In the description below, the pilot passageway 50 through which the pilot oil having a pressure adjusted in the boom interposition control flows will be appropriately referred to as interposition passageways 501 and 502.

The pilot oil to be supplied to the direction control valve 640 connected to the boom cylinder 10 flows to the interposition passageway 501. The interposition passageway 501 is connected through the shuttle valve 51 to the boom operation passageway 4510B and the boom adjustment passageway 4520B connected to the direction control valve 640.

The shuttle valve 51 includes two inlets and one outlet. One inlet is connected to the interposition passageway 501. The other inlet is connected to the boom operation passageway 4510B. The outlet is connected to the boom adjustment passageway 4520B. The shuttle valve 51 connects the passageway having the higher pilot hydraulic pressure among the interposition passageway 501 and the boom operation passageway 4510B to the boom adjustment passageway 4520B. For example, when the pilot hydraulic pressure of the interposition passageway 501 is higher than the pilot hydraulic pressure of the boom operation passageway 4510B, the shuttle valve 51 operates so as to connect the interposition passageway 501 and the boom adjustment passageway 4520B to each other and so as not to connect the boom operation passageway 4510B and the boom adjustment passageway 4520B to each other. As a result, the pilot oil of the interposition passageway 501 is supplied to the boom adjustment passageway 4520B through the shuttle valve 51. When the pilot hydraulic pressure of the boom operation passageway 4510B is higher than the pilot hydraulic pressure of the interposition passageway 501, the shuttle valve 51 operates so as to connect the boom operation passageway 4510B and the boom adjustment passageway 4520B to each other and so as not to connect the interposition passageway 501 and the boom adjustment passageway 4520B to each other. Thus, the pilot oil of the boom operation passageway 4510B is supplied to the boom adjustment passageway 4520B through the shuttle valve 51.

The interposition valve 27C and the pressure sensor 68 which detects the pilot hydraulic pressure of the pilot oil of the interposition passageway 501 are provided in the interposition passageway 501. The interposition passageway 501 includes the interposition passageway 501 through which the pilot oil flows before passing through the interposition valve 27C and the interposition passageway 502 through which the pilot oil flows after having passed through the interposition valve 27C. The interposition valve 27C is controlled based on the control signal output from the working unit controller 26 in order to perform the boom interposition control.

When the boom interposition control is not performed, the direction control valve 64 is driven based on the pilot hydraulic pressure adjusted by the operation of the operation device 25. For example, the working unit controller 26 opens (fully opens) the boom operation passageway 4510B by the boom depressurization valve 270B and closes the interposition passageway 501 by the interposition valve 27C so as to drive the direction control valve 640 based on the pilot hydraulic pressure adjusted by the operation of the operation device 25.

When the boom interposition control is performed, the working unit controller 26 controls each control valve 27 so that the direction control valve 640 is driven based on the pilot hydraulic pressure adjusted by the interposition valve 27C. For example, when the boom interposition control of limiting the movement of the boom 6 is performed in the excavation control, the working unit controller 26 controls the interposition valve 27C so that the pilot hydraulic pressure of the interposition passageway 50 adjusted by the interposition valve 27C becomes higher than the pilot hydraulic pressure of the boom operation passageway 4510B to be adjusted by the operation device 25. In this way, the pilot oil from the interposition valve 27C is supplied to the direction control valve 640 through the shuttle valve 51.

When the boom 6 is moved upward at a high speed by the operation device 25 so that the bucket 8 does not enter the target excavation ground shape 43I, the boom interposition control is not performed. In this case, the operation device 25 is operated so that the boom 6 moves upward at a high speed and the pilot hydraulic pressure is adjusted based on the operation amount, and thus the pilot hydraulic pressure of the boom operation passageway 4510B to be adjusted by the operation of the operation device 25 becomes higher than the pilot hydraulic pressure of the interposition passageway 501 to be adjusted by the interposition valve 27C. As a result, the pilot oil of the boom operation passageway 4510B having the pilot hydraulic pressure adjusted by the operation of the operation device 25 is supplied to the direction control valve 640 through the shuttle valve 51.

In the boom interposition control, the working unit controller 26 determines whether the limitation condition is satisfied. The limitation condition includes a condition in which the distance d is smaller than the above-described first predetermined value dth1 and a condition in which the boom limitation velocity Vc_bm_lmt is larger than the boom target velocity Vc_bm. For example, when the magnitude of the boom limitation velocity Vc_bm_lmt in the downward direction of the boom 6 is smaller than the magnitude of the boom target velocity Vc_bm in the downward direction in the case where the boom 6 moves downward, the working unit controller 26 determines that the limitation condition is satisfied. Furthermore, when the magnitude of the boom limitation velocity Vc_bm_lmt in the upward direction of the boom 6 is larger than the magnitude of the boom target velocity Vc_bm in the upward direction in the case where the boom 6 moves upward, the working unit controller 26 determines that the limitation condition is satisfied.

When the limitation condition is satisfied, the working unit controller 26 generates the boom interposition instruction CBI so that the boom moves upward at the boom limitation velocity Vc_bm_lmt, and controls the control valve 27 of the boom cylinder 10. In this way, since the direction control valve 640 of the boom cylinder 10 supplies the working oil to the boom cylinder 10 so that the boom moves upward at the boom limitation velocity Vc_bm_lmt, the boom cylinder 10 moves the boom 6 upward at the boom limitation velocity Vc_bm_lmt.

In the first embodiment, the limitation condition may include a condition in which the absolute value of the arm limitation velocity Vc_am_lmt is smaller than the absolute value of the arm target velocity Vc_am. The limitation condition may further include other condition. For example, the limitation condition may further include a condition in which the arm operation amount is zero. The limitation condition may not include the condition in which the distance d is smaller than the first predetermined value dth1. For example, the limitation condition may only be the condition in which the limitation velocity of the boom 6 is larger than the boom target velocity.

The second predetermined value dth2 may be larger than zero as long as the second predetermined value is smaller than the first predetermined value dth1. In this case, both the boom 6 and the arm 7 are limited before the blade tip 8T of the boom 6 reaches the target excavation ground shape 43I. For this reason, when the blade tip 8T of the boom 6 moves beyond the target excavation ground shape 43I even before the blade tip 8T of the boom 6 reaches the target excavation ground shape 43I, both the boom 6 and the arm 7 can be limited.

(Case where Operation Lever is of Electric Type)

When the left operation lever 25L and the right operation lever 25R are of an electric type, the working unit controller 26 acquires an electric signal of a potentiometer or the like corresponding to the operation lever 25L and the right operation lever 25R. The electric signal will be referred to as an operation instruction current value. The working unit controller 26 outputs the opening/closing instruction based on the operation instruction current value to the control valve 27. Since the working oil of the pressure responding to the opening/closing instruction is supplied from the control valve 27 to the spool of the direction control valve and moves the spool, the working oil is supplied to the boom cylinder 10, the arm cylinder 11, or the bucket cylinder 12 through the direction control valve and the cylinders move in a telescopic manner.

In the excavation control, the working unit controller 26 outputs the opening/closing instruction based on an instruction value of the excavation control and the operation instruction current value to the control valve 27. The instruction value of the excavation control is, for example, the above-described boom interposition instruction CBI, and is an instruction value used for performing the boom interposition control in the excavation control. In the control valve 27 that receives the opening/closing instruction, the working oil of the pressure responding to the opening/closing instruction is supplied to the spool of the direction control valve and moves the spool. Since the working oil of the pressure responding to the instruction value of the excavation control is supplied to the spool of the direction control valve of the boom cylinder 10, the boom cylinder 10 extends to move the boom 6 upward.

Next, a more detailed description will be given about a control (a work machine control method according to the embodiment) in a case where when the excavator 100 is performing the excavation control, the reference position data items P1 and P2, for example, cannot be received and as a result the working unit controller 26 cannot acquire the target excavation ground shape data item U.

<Control in Case where Working Unit Controller 26 Cannot Acquire Target Excavation Ground Shape Data Item U>

Figure 16A:
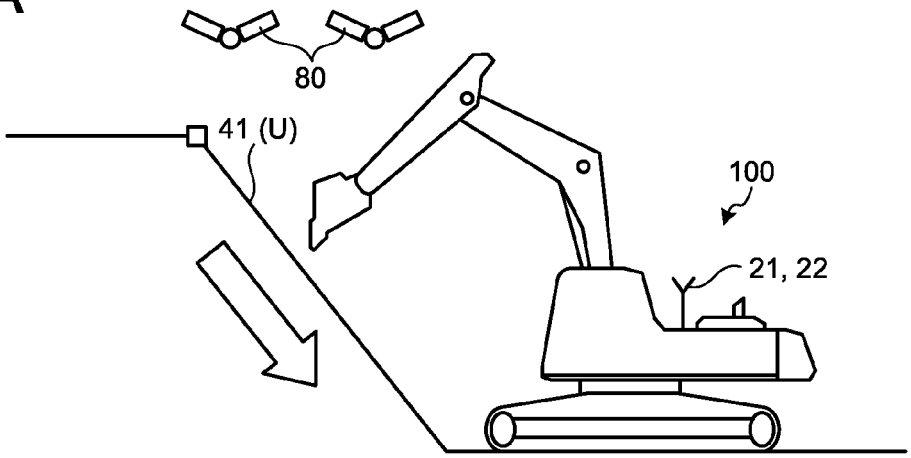
FIG. 16A is a diagram illustrating a state where the excavator is performing the excavation control.
Figure 16B:
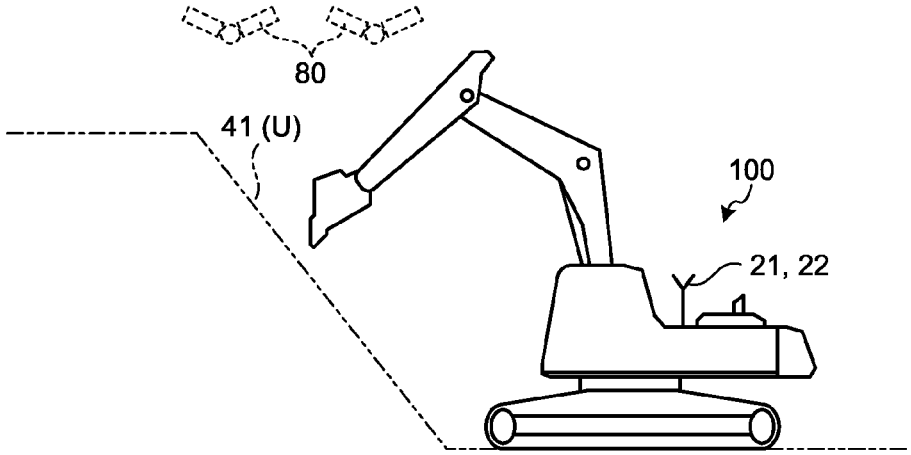
FIG. 16B is a diagram illustrating a state where a reference position data item cannot be received when the excavator is performing the excavation control.
Figure 16C:
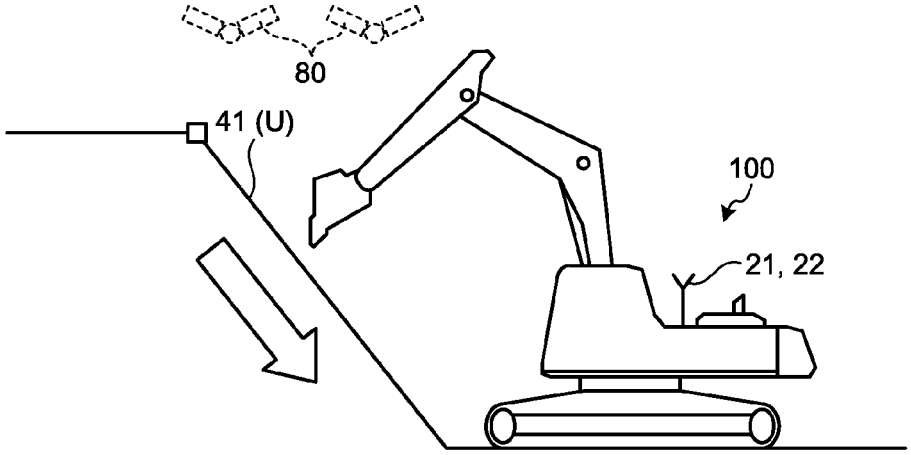
FIG. 16C is a diagram illustrating a state where the excavation control is continued based on a design ground shape data item stored in a data item storage unit when the reference position data item cannot be received.

FIG. 16A is a diagram illustrating a state where the excavator 100 is performing the excavation control. FIG. 16B is a diagram illustrating a state where the reference position data items P1 and P2 cannot be received when the excavator 100 is performing the excavation control. FIG. 16C is a diagram illustrating a state where the excavation control is continued based on the target excavation ground shape data item U stored in the data item storage unit 58 when the reference position data items P1 and P2 cannot be received.

For example, as illustrated in FIG. 16A, it is assumed that the GNSS antennas 21 and 22 illustrated in FIGS. 1 and 2 cannot receive the reference position data items P1 and P2 from the positioning satellite when the excavator 100 is performing the excavation control by using the target excavation ground shape data item U of the target excavation ground shape 43I. In this case, the error determination unit 28D of the display controller 28 illustrated in FIG. 5 outputs the error signal J to the working unit controller 26. The case where the reference position data items P1 and P2 cannot be received includes, for example, a case where when the working unit 2 of the excavator 100 is caused to move upward and the working unit 2 is caused to swing, the working unit 2 intervenes between the positioning satellite and the GNSS antennas 21 and 22 and becomes a shielding object against the reception of the GNSS antenna. Since the reference position data items P1 and P2 are received from a plurality of positioning satellites in general, there is a small possibility that these data items cannot be received; however, when the above-described operation is performed in a situation of particularly weak radio wave or the like, a state where the reference position data items P1 and P2 cannot be received sometimes occurs. This is a phenomenon that appears in the excavator 100 in which the working unit 2 is located at a higher position than the GNSS antennas 21 and 22 particularly during work.

When the reference position data items P1 and P2 are not received, the bucket blade tip position data item generation unit 28B cannot generate the bucket blade tip position data item S, and hence the target excavation ground shape data item generation unit 28C cannot generate the target excavation ground shape data item U. When the target excavation ground shape data item U cannot be acquired when the working unit controller 26 is performing the excavation control, the working unit controller 26 cannot perform the excavation control. In this case, as illustrated in FIG. 16B, the working unit control unit 57 of the working unit controller 26 does not perform drive of the control valve 27 and the interposition valve 27C by the working unit controller 26. A mode in which the excavation control is not performed and the working unit 2 is operated based on the input to the operation device 25 illustrated in FIG. 2 will be referred to as a manual excavation mode in the present embodiment.

As described above, when the GNSS antennas 21 and 22 cannot receive the reference position data items P1 and P2 from the positioning satellite, the display controller 28 performs the initialization work as described above. In this case, since the working unit controller 26 cannot acquire the target excavation ground shape data item U, the excavation control cannot be continued. Accordingly, the working unit controller 26 cancels the excavation control and selects the manual excavation mode, and the display controller 28 causes the display unit 29 to display the fact that the manual excavation mode is selected. In this case, the display controller 28 may issue an error if necessary.

In the embodiment, when the switching unit 59 acquires the error signal J, the target excavation ground shape data item U stored in the data item storage unit 58 is output to the distance acquisition unit 53. For this reason, the working unit controller 26 can continue the excavation control by using the target excavation ground shape data item U stored in the data item storage unit 58 as illustrated in FIG. 16C until the time in which the data item storage unit 58 stores the target excavation ground shape data item U elapses even when the target excavation ground shape data item U cannot be acquired from the target excavation ground shape data item generation unit 28C.

Even in the case where the reference position data items P1 and P2 cannot be received and as a result the target excavation ground shape data item generation unit 28C cannot generate the new target excavation ground shape data item U, there is no problem even when the excavation control is continued based on the target excavation ground shape data item U stored in the data item storage unit 58 as long as the excavation is performed in a state where the same excavation target as the excavation target before the reference position data items P1 and P2 cannot be received maintains a constant relative positional relation with the working unit 2 of the excavator 100. The case where the relative positional relation between the working unit 2 and the excavation target is maintained constant is, for example, a state where the working unit 2 does not swing, a state where the working unit swings within a predetermined swing angle, a state where the excavator 100 is not traveling, or a case where the excavator is traveling a predetermined traveling distance or less.

In the embodiment, when the reference position data items P1 and P2 cannot be received, the working unit controller 26 continues the excavation control by using the target excavation ground shape data item U stored in the data item storage unit 58 on the condition that the relative positional relation between the working unit 2 and the excavation target is maintained constant. A recovery from the phenomenon in which the GNSS antennas 21 and 22 cannot receive the reference position data items P1 and P2 from the positioning satellite takes a comparatively short time (for example, about several seconds) in many cases. For this reason, in many cases it also becomes possible to receive the reference position data items P1 and P2 while the excavation control is continued based on the target excavation ground shape data item U stored in the data item storage unit 58. Once the reference position data items P1 and P2 can be received during the excavation control based on the target excavation ground shape data item U stored in the data item storage unit 58, the working unit controller 26 performs the excavation control by using the target excavation ground shape data item U generated subsequently by the target excavation ground shape data item generation unit 28C.

As described above, the excavation control is performed or stopped by the operator's operation on the switch 29S illustrated in FIG. 2. When the operator has to operate the switch 29S in order to resume the excavation control after the GNSS antennas 21 and 22 cannot receive the reference position data items P1 and P2 from the positioning satellite and as a result the excavation control is temporarily stopped, the operator needs to perform operation other than the excavation work. In the embodiment, the working unit controller 26 can continue the excavation control even when the GNSS antennas 21 and 22 cannot receive the reference position data items P1 and P2 from the positioning satellite. For this reason, since the need for the operation of resuming the stopped excavation control is eliminated, the burden of the operator is reduced.

When the reference position data items P1 and P2 cannot be received and the relative positional relation between the working unit 2 and the excavation target is not maintained constant or when the reference position data items P1 and P2 cannot be received for a predetermined time or more, the working unit controller 26 selects the manual excavation mode as the state where the excavation control is temporarily stopped. At this time, the data item storage unit 58 ends the storage of the target excavation ground shape data item U. Even after the storage of the target excavation ground shape data item U by the data item storage unit 58 ends, once the reference position data items P1 and P2 can be received, the working unit controller 26 performs the excavation control by using the target excavation ground shape data item U generated subsequently by the target excavation ground shape data item generation unit 28C. That is, even when the operator does not operate the switch 29S illustrated in FIG. 2, the working unit controller 26 performs the excavation control. In this way, in the embodiment, even after the storage of the target excavation ground shape data item U by the data item storage unit 58 ends, the working unit controller 26 stands by in a state of being able to perform the excavation control on the condition that the reception of the reference position data items P1 and P2 has resumed. Since such a process eliminates the need of the operation of resuming the stopped excavation control, the burden of the operator is reduced.

<Regarding Target Excavation Ground Shape Data Item U Stored in Data Item Storage Unit 58>

Figure 17:
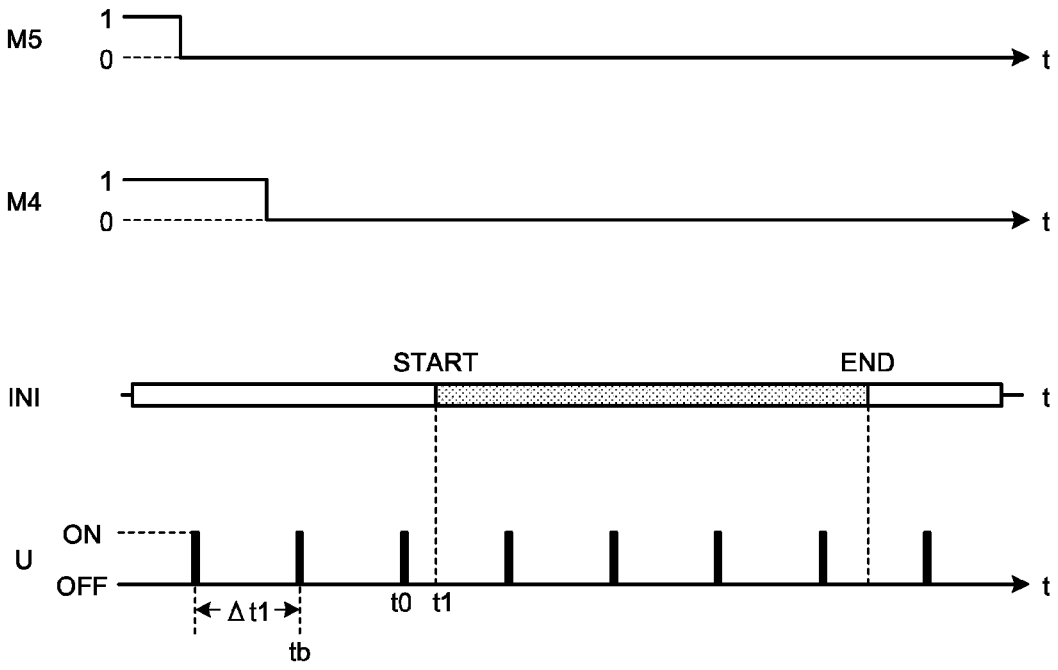
FIG. 17 is a diagram illustrating the design ground shape data item which is stored in the data item storage unit.
Figure 18:
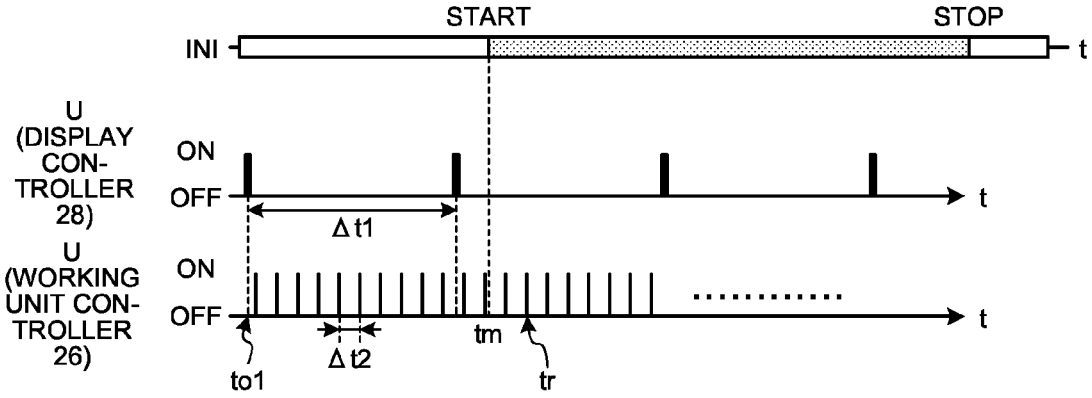
FIG. 18 is a diagram illustrating the design ground shape data item which is stored in the data item storage unit.

FIGS. 17 and 18 are diagrams illustrating the target excavation ground shape data item U stored in the data item storage unit 58. In FIGS. 17 and 18, the horizontal axis is a time t, M4 is a swing signal, M5 is a traveling signal, INI is initialization of the display controller 28, and U is an input/output of a design ground shape data item. The target excavation ground shape data item U illustrated in FIG. 17 is output from the display controller 28, and the target excavation ground shape data item U illustrated in FIG. 18 is acquired by the working unit controller 26. In the present embodiment, the swing signal M4 is the angle information item which is detected by the IMU 24 as the swing angle detection device illustrated in FIG. 2, and it is determined that the upper swing body 3 is swinging when the angle information item detected by the IMU 24 is equal to or more than a predetermined magnitude.

The angle information item includes, for example, a swing angle. The integration of the angle is started from a time tm illustrated in FIG. 18. Furthermore, the swing angle is obtained by the integral of the angular velocity. The swing signal M4 may be output from an encoder (the swing angle detection device) that detects the swing angle of the upper swing body 3. When it is determined that the upper swing body 3 is swinging, it is desirable to detect the swing angle of the upper swing body 3 because a swing instruction of the operator can be more reliably identified. The traveling signal M5 is determined based on the operation amount MD when at least one of the traveling pedals 25FL and 25FR illustrated in FIG. 2 is operated. When the operation amount MD is equal to or more than a predetermined operation amount, the operation device 25 illustrated in FIG. 2 outputs the traveling signal M5 as one, assuming that the vehicle body 1 is in a traveling state. When the operation amount MD is less than the predetermined operation amount, the operation device 25 illustrated in FIG. 2 outputs the traveling signal M5 as zero, assuming that the vehicle body 1 is in a stop state.

When the INI becomes START, the initialization of the display controller 28 starts, and when the INI becomes END, the initialization ends. A time point at which the initialization starts is after the GNSS antennas 21 and 22 cannot receive the reference position data items P1 and P2 from a positioning satellite 80. The target excavation ground shape data item U which is output from the target excavation ground shape data item generation unit 28C illustrated in FIG. 17 is output from the target excavation ground shape data item generation unit 28C to the working unit controller 26 when being ON. When being OFF, any target excavation ground shape data item U is output, but an information item indicating that the reliability thereof is not guaranteed or that the output thereof is invalid is output. In the embodiment, since the target excavation ground shape data item U is output at 10 Hz from the target excavation ground shape data item generation unit 28C, a cycle Δt1 is 100 msec. The target excavation ground shape data item U acquired by the working unit controller 26 illustrated in FIG. 18 is acquired by the working unit controller 26 when being ON, and is not acquired when being OFF. In the embodiment, since the working unit controller 26 acquires the target excavation ground shape data item U at 100 Hz, a cycle Δt2 illustrated in FIG. 18 is 10 msec.

In the embodiment, when the GNSS antennas 21 and 22 cannot receive the reference position data items P1 and P2 from the positioning satellite 80 and as a result the target excavation ground shape data item U as the target excavation ground shape information item cannot be acquired during the excavation control, the working unit controller 26 performs the excavation control by using the target excavation ground shape data item U obtained before the time point at which the target excavation ground shape data item U cannot be acquired. In the example illustrated in FIG. 17, since the initialization is started at the time t1, the target excavation ground shape data item U which is output from the target excavation ground shape data item generation unit 28C before at least the time t1 and is stored in the data item storage unit 58 is used. There is no guarantee that the initialization of the display controller 28 is synchronized with a time point at which the target excavation ground shape data item generation unit 28C outputs the target excavation ground shape data item U. For this reason, there is a possibility that the reliability be low in the target excavation ground shape data item U (time t=t0) obtained immediately before the initialization of the display controller 28 is started, that is, immediately before the GNSS antennas 21 and 22 cannot receive the reference position data items P1 and P2 from the positioning satellite 80. It is desirable that the data item storage unit 58 of the working unit controller 26 store the target excavation ground shape data item U (time t=tb) output from the target excavation ground shape data item generation unit 28C at a time point one cycle before the initialization of the display controller 28 is started.

In the example illustrated in FIG. 18, the time point at which the display controller 28 starts the initialization is time t=tm. After the initialization of the display controller 28 is started, that is, the GNSS antennas 21 and 22 cannot receive the reference position data items P1 and P2 from the positioning satellite 80, the working unit controller 26 recognizes the fact (time t=tr). The working unit controller 26 cannot distinguish the target excavation ground shape data item U (time t=to1) output from the target excavation ground shape data item generation unit 28C at the time point one cycle before the initialization of the display controller 28 is started.

The data item storage unit 58 of the working unit controller 26 stores the target excavation ground shape data item U acquired from the target excavation ground shape data item generation unit 28C of the display controller 28 before a time point of recognizing that the GNSS antennas 21 and 22 cannot receive the reference position data items P1 and P2 from the positioning satellite 80. In the embodiment, it is desirable that the data item storage unit 58 store the target excavation ground shape data item U acquired at least one cycle or more before the time point of recognizing that the GNSS antennas 21 and 22 cannot receive the reference position data items P1 and P2, in terms of the cycle in which the target excavation ground shape data item generation unit 28C of the display controller 28 outputs the target excavation ground shape data item U. In the example illustrated in FIG. 18, it is desirable that the data item storage unit 58 store the target excavation ground shape data item U at time t=to1.

The cycle in which the target excavation ground shape data item generation unit 28C outputs the target excavation ground shape data item U is 100 msec, and the cycle in which the working unit controller 26 acquires the target excavation ground shape data item U is 10 msec. In terms of the cycle in which the working unit controller 26 acquires the target excavation ground shape data item U, it is desirable that the data item storage unit 58 store the target excavation ground shape data item U acquired at least 10 cycles or more (in the embodiment, 15 cycles) before in terms of the cycle in which the working unit controller 26 acquires the target excavation ground shape data item U.

In this way, the data item storage unit 58 can output the target excavation ground shape data item U acquired at least 10 cycles or more before to the distance acquisition unit 53 when the GNSS antennas 21 and 22 cannot receive the reference position data items P1 and P2 from the positioning satellite 80. As a result, a possibility that the data item storage unit 58 store the abnormal target excavation ground shape data item U and a possibility that the excavation control be continued by using the abnormal target excavation ground shape data item U can be reduced.

The target excavation ground shape data item U (a target excavation ground shape 731) is input from the display controller 28 to the working unit controller 26 in, for example, a cycle of 100 msec. The inclination angle θ5 which is detected by the IMU 29 is input from the sensor controller 39 to the working unit controller 26 and the second display device 39 every, for example, 10 msec. The working unit controller 26 and the display controller 28 continues to update the inclination angle θ5 of the target excavation ground shape data item U (the target excavation ground shape 43I) based on an increase/decrease amount of a precedent pitch angle value and a current pitch angle value input from the sensor controller 39. The working unit controller 26 calculates the blade tip position P4 by using the inclination angle θ5 and performs the excavation control, and the display controller 28 calculates the blade tip position P4 by using the inclination angle θ5 and adopts the position as the blade tip position of a guidance image. After 100 msec elapse, the new target excavation ground shape data item U (the new target excavation ground shape 43I) is input from the display controller 28 to the working unit controller 26 and the target excavation ground shape data item is updated.

Control Example of Work Machine Control According to Embodiment

Figure 19:
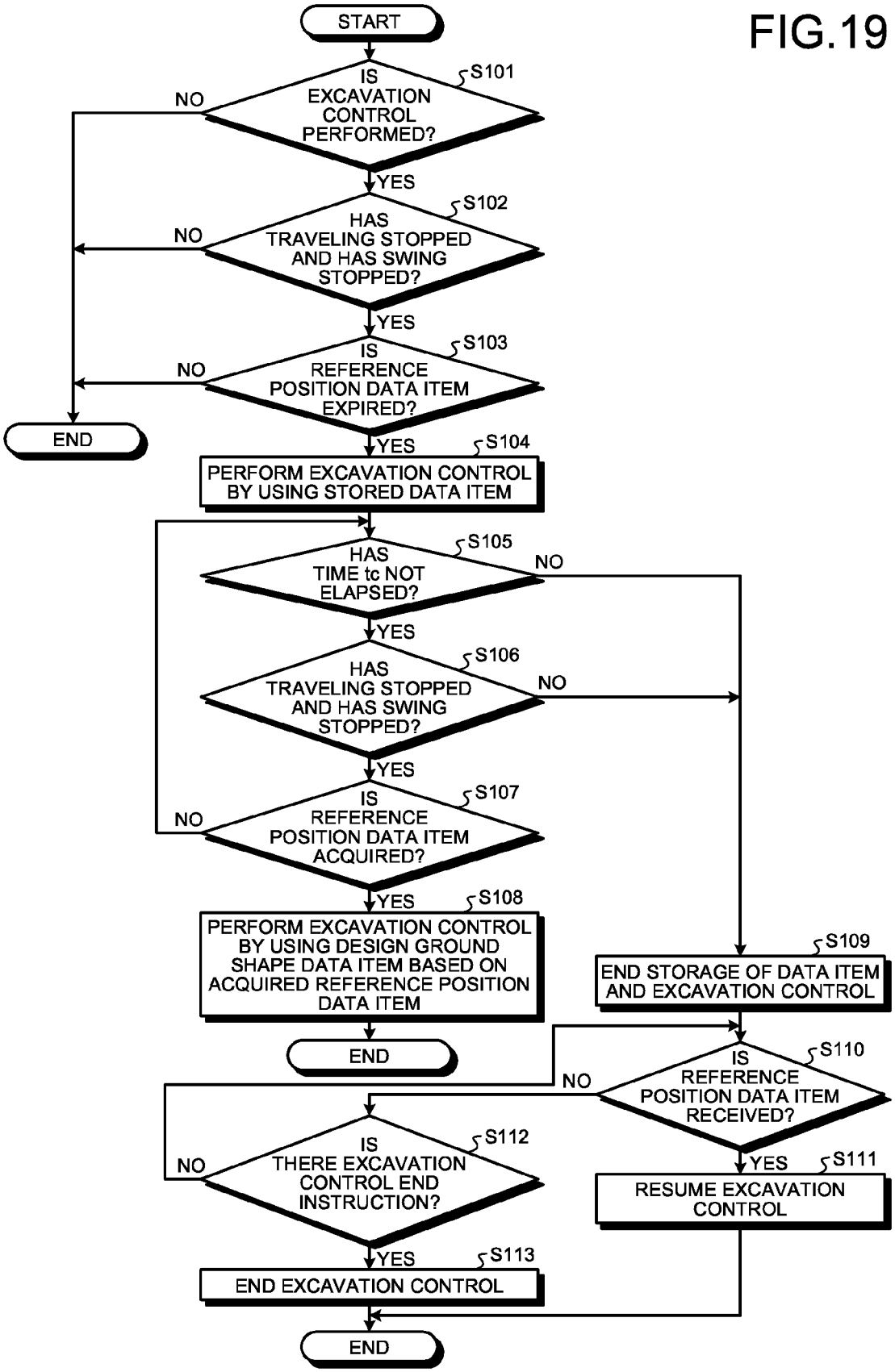
FIG. 19 is a flowchart illustrating a control example of a working unit control according to an embodiment.

FIG. 19 is a flowchart illustrating a control example of the work machine control according to the embodiment. In step S101, when the excavation control is being performed (step S101, Yes), the working unit controller 26 illustrated in FIG. 5 advances the process to step S102. In step S101, when the excavation control is not being performed (step S101, No), the working unit controller 26 ends the work machine control according to the embodiment.

In step S102, when the traveling of the excavator 100 has stopped and the swing of the working unit 2 has stopped (step S102, Yes), the working unit controller 26 advances the process to step S103. In step S102, when the excavator 100 is traveling or the working unit 2 is swinging (step S102, No), the working unit controller 26 ends the work machine control according to the embodiment. The working unit controller 26 determines that the excavator 100 has stopped when a signal obtained from the traveling lever of the excavator 100 indicates a stop state, and determines that the swing of the working unit 2 has stopped when the swing angle of the working unit 2 is equal to or less than a predetermined threshold value. The predetermined threshold value is a magnitude in which the relative positional relation between the working unit 2 and the excavation target is considered to be unchanged.

In step S103, when the reference position data items P1 and P2 are expired, that is, the GNSS antennas 21 and 22 cannot receive the reference position data items P1 and P2 from the positioning satellite 80 (step S103, Yes), the error determination unit 28D of the display controller 28 in the working unit controller 26 outputs the error signal J to the switching unit 59 of the working unit controller 26 in step S104. The switching unit 59 which has acquired the error signal J switches the target excavation ground shape data item U to be output to the distance acquisition unit 53 from the data item generated by the target excavation ground shape data item generation unit 28C of the display controller 28 to the data item stored in the data item storage unit 58. The working unit controller 26 continues the excavation control by using the target excavation ground shape data item U stored in the data item storage unit 58. As described above, the target excavation ground shape data item U which is used in the excavation control in step S104 is the target excavation ground shape data item U which is acquired by the working unit controller 26 at least 10 cycles or more before among the target excavation ground shape data item U stored in the data item storage unit 58. In step S103, when the reference position data items P1 and P2 are not expired (step S103, No), the working unit controller 26 ends the work machine control according to the embodiment.

When step S104 ends, the working unit controller 26 determines whether a predetermined certain time tc has not elapsed in step S105. When the predetermined time tc has not elapsed (step S105, Yes), the process proceeds to step S106. In step S106, when the traveling of the excavator 100 has stopped and the swing of the working unit 2 has stopped (step S106, Yes), the working unit controller 26 advances the process to step S107.

In step S107, when the GNSS antennas 21 and 22 can receive the reference position data items P1 and P2 from the positioning satellite 80 (step S107, Yes), the process proceeds to step S108. When the GNSS antennas 21 and 22 can receive the reference position data items P1 and P2 from the positioning satellite 80, the bucket blade tip position data item generation unit 28B generates the bucket blade tip position data item S and outputs the data item to the target excavation ground shape data item generation unit 28C. The target excavation ground shape data item generation unit 28C generates the target excavation ground shape data item U and outputs the data item to the working unit controller 26. In step S108, the working unit controller 26 performs the excavation control by using the target excavation ground shape data item U which is newly generated by the target excavation ground shape data item generation unit 28C based on the received reference position data items P1 and P2. When the GNSS antennas 21 and 22 cannot receive the reference position data items P1 and P2 from the positioning satellite 80 (step S107, No), the working unit controller 26 repeats step S105 to step S107 until the certain time tc elapses.

Returning to step S105, when the certain time tc elapses (step S105, No), the data item storage unit 58 of the working unit controller 26 ends the storage of the stored target excavation ground shape data item U and the working unit controller 26 ends the excavation control in step S109. In this case, a manual operation mode is adopted. The manual operation mode is a mode in which the working unit 2 is operated in response to the input of the operation device 25.

Next, when the GNSS antennas 21 and 22 can receive the reference position data items P1 and P2 from the positioning satellite 80 in step S110 (step S110, Yes), the process proceeds to step S111. In step S111, the working unit controller 26 resumes the excavation control by using the target excavation ground shape data item U which is newly generated by the target excavation ground shape data item generation unit 28C based on the received reference position data items P1 and P2. In this case, the operator of the excavator 100 does not need to operate the switch 29S illustrated in FIG. 2 again in order to resume the excavation control.

When the GNSS antennas 21 and 22 cannot receive the reference position data items P1 and P2 from the positioning satellite 80 (step S110, No), the process proceeds to step S112. In step S112, when there is an excavation control end instruction (step S112, Yes), the working unit controller 26 ends the excavation control in step S113. The excavation control end instruction is generated in a manner such that the operator of the excavator 100 operates the switch 29S illustrated in FIG. 2. When there is no excavation control end instruction (step S112, No), the working unit controller 26 returns to step S110 and performs a subsequent process. In step S106 described above, when the excavator 100 is traveling or the working unit 2 is swinging (step S106, No), the working unit controller 26 proceeds to step S109 and performs a subsequent process. In this way, the control system 300 illustrated in FIG. 2 performs the work machine control according to the embodiment.

While the embodiment has been described as above, the embodiment is not limited to the above-described content. Furthermore, the above-described component includes a component which can be easily envisaged by the person skilled in the art, a component which is substantially the same, and a component within a so-called equivalent scope. Further, it is possible to combine the above-described components appropriately. Further, at least one of various omissions, substitutions, and modifications of the components can be made without departing from the spirit of the embodiment. For example, the working unit 2 includes the boom 6, the arm 7, and the bucket 8, but the attachment attached to the working unit 2 is not limited thereto nor limited to the bucket 8. The processes performed by the sensor controller 39 may be performed by the working unit controller 26. The work machine is not limited to the excavator 100, and may be other construction machines.

REFERENCE SIGNS LIST

1 VEHICLE BODY
2 WORKING UNIT
3 UPPER SWING BODY
6 BOOM
7 ARM
8 BUCKET
8B BLADE
8T BLADE TIP
10 BOOM CYLINDER
11 ARM CYLINDER
12 BUCKET CYLINDER
19 POSITION DETECTION DEVICE
23 GLOBAL COORDINATE CALCULATION UNIT
25 OPERATION DEVICE
26 WORKING UNIT CONTROLLER
26M STORAGE UNIT
26P PROCESS UNIT
27 CONTROL VALVE
28 DISPLAY CONTROLLER
28A TARGET CONSTRUCTION INFORMATION ITEM STORAGE UNIT
28B BUCKET BLADE TIP POSITION DATA ITEM GENERATION UNIT
28C TARGET EXCAVATION GROUND SHAPE DATA ITEM GENERATION UNIT
28D ERROR DETERMINATION UNIT
29 DISPLAY UNIT
29S SWITCH
41 TARGET EXCAVATION SURFACE
42 PLANE
43I TARGET EXCAVATION GROUND SHAPE
44 EXCAVATION TARGET POSITION
52 TARGET VELOCITY DETERMINATION UNIT
53 DISTANCE ACQUISITION UNIT
54 LIMITATION VELOCITY DETERMINATION UNIT
55 FIRST LIMITATION DETERMINATION UNIT
57 WORKING UNIT CONTROL UNIT
58 DATA ITEM STORAGE UNIT
59 SWITCHING UNIT
60 ALIGNMENT MARKER
100 EXCAVATOR
200 WORK MACHINE CONTROL SYSTEM (CONTROL SYSTEM)
300 HYDRAULIC SYSTEM

The invention claimed is:

1. A work machine control system that controls a work machine including a working unit with a working tool, the work machine control system comprising:

a position detection device that detects a position information item of the work machine;

a generation unit that obtains a position of the working unit based on the position information item detected by the position detection device and generates a target excavation ground shape information item indicating a target shape of an excavation target of the working unit from an information item of a target construction face indicating the target shape; and a working unit control unit that performs an excavation control of controlling a velocity in a direction in which the working unit approaches the excavation target so that the velocity becomes equal to or less than a limitation velocity based on the target excavation ground shape information item acquired from the generation unit, wherein when the working unit control unit is not able to acquire the target excavation ground shape information item during the excavation control, the working unit control unit continues the excavation control by using the target excavation ground shape information item obtained before a time point at which the working unit control unit is not able to acquire the target excavation ground shape information item.

2. The work machine control system according to claim 1, wherein the working unit control unit stores the target excavation ground shape information item obtained before the time point at which the working unit control unit is not able to acquire the target excavation ground shape information item for a predetermined time, and wherein the working unit control unit ends the excavation control being currently performed by ending the storage of the target excavation ground shape information item when the predetermined time elapses, the work machine travels, or a swing body to which the working unit is attached swings.

3. The work machine control system according to claim 2, comprising:

a swing angle detection device that detects a swing angle of the swing body, and wherein when the swing angle detected by the swing angle detection device is equal to or more than a predetermined magnitude, the working unit control unit ends the storage of the target excavation ground shape information item to end the excavation control being currently performed.

4. The work machine control system according to claim 2, wherein the working unit control unit updates the stored target excavation ground shape information item by using an inclination angle detected by a device that obtains the inclination angle of the work machine.

5. The work machine control system according to claim 1, wherein when the working unit control unit acquires the target excavation ground shape information item which is new before a predetermined time elapses, the working unit control unit starts the excavation control by using the acquired target excavation ground shape information item.

6. The work machine control system according to claim 2, wherein when the working unit control unit acquires the target excavation ground shape information item which is new after ending the excavation control being currently performed, the working unit control unit starts the excavation control by using the acquired target excavation ground shape information item.

7. An excavator control system that controls a work machine including a working unit with a working tool, the excavator control system comprising:

a position detection device that detects a position information item of the work machine;

a generation unit that obtains a position of the working unit based on the position information item detected by the position detection device and generates a target excavation ground shape information item indicating a target shape of an excavation target of the working unit from an information item of a design face indicating the target shape; and a working unit control unit that performs an excavation control of restraining the working unit from performing an excavation beyond the target shape based on the target excavation ground shape information item acquired from the generation unit, wherein when the position detection device is not able to detect the position information item of the work machine during the excavation control, the working unit control unit continues the excavation control by storing the target excavation ground shape information item obtained before a time point at which the position information item is not able to be detected, for a predetermined time, and wherein the working unit control unit ends the excavation control being currently performed by ending the storage of the target excavation ground shape information item when the predetermined time elapses, the working unit travels, or the working unit swings.

8. A work machine comprising:

the work machine control system according to claim 7.

9. A work machine control method that controls a work machine including a working unit with a working tool, the work machine control method comprising:

detecting a position information item of the work machine;

obtaining a position of the working unit based on the detected position information item and generating a target excavation ground shape information item indicating a target shape of an excavation target of the working unit from an information item of a design face indicating the target shape; and performing an excavation control of restraining the working unit from performing an excavation beyond the target shape based on the target excavation ground shape information item and, when the target excavation ground shape information item is not able to be acquired during the excavation control, continuing the excavation control by storing the target excavation ground shape information item obtained before a time point at which the target excavation ground shape information item is not able to be acquired, for a predetermined time.

10. A work machine comprising: control system that controls a work machine including a working unit with a working tool, the work machine control system comprising:

a position detection device that detects a position information item of the work machine;

a generation unit that obtains a position of the working unit based on the position information item detected by the position detection device and generates a target excavation ground shape information item indicating a target shape of an excavation target of the working unit from an information item of a target construction face indicating the target shape; and a working unit control unit that performs an excavation control of controlling a velocity in a direction in which the working unit approaches the excavation target so that the velocity becomes equal to or less than a limitation velocity based on the target excavation ground shape information item acquired from the generation unit, wherein when the working unit control unit is not able to acquire the target excavation ground shape information item during the excavation control, the working unit control unit continues the excavation control by using the target excavation ground shape information item obtained before a time point at which the working unit control unit is not able to acquire the target excavation ground shape information item.

* * * * *